US005241124A

United States Patent [19]

Adachi et al.

[11] Patent Number: 5,241,124

[45] Date of Patent: Aug. 31, 1993

[54] ELECTRONIC MUSICAL INSTRUMENT CAPABLE OF CONTROLLING TOUCH RESPONSE BASED ON A REFERENCE VALUE

[75] Inventors: Takeshi Adachi; Masatada Wachi; Kenji Itakura; Masashi Hirano, all of Hamamatsu, Japan

[73] Assignee: Yamaha Corporation, Hamamatsu, Japan

[21] Appl. No.: 687,581

[22] Filed: Apr. 12, 1991

[30] Foreign Application Priority Data

Apr. 18, 1990 [JP] Japan ..... 2-100264
Apr. 23, 1990 [JP] Japan ..... 2-105297

[51] Int. Cl.[5] ..... G10H 1/18
[52] U.S. Cl. ..... 84/607; 84/658
[58] Field of Search ..... 84/607, 615, 622, 626, 84/647, 653, 658, 678, 687, 633, 623, DIG. 8, DIG. 7

[56] References Cited

U.S. PATENT DOCUMENTS 4,138,915 2/1979 Nagai et al. ..... 84/623
4,301,704 11/1981 Nagai et al. .
4,528,885 7/1985 Chihana .
4,681,007 8/1987 Nikaido et al. ..... 84/626
4,779,505 10/1988 Suzuki ..... 84/622
4,875,400 10/1989 Okuda et al. ..... 84/633
4,882,751 5/1975 Tomisawa .
4,972,753 11/1990 Adachi et al. ..... 84/626
4,979,423 12/1990 Watanabe .
5,027,690 7/1991 Wachi et al. ..... 84/626
5,109,746 5/1992 Takauji et al. ..... 84/607

FOREIGN PATENT DOCUMENTS 52-46088 11/1977 Japan .
59-105692 6/1984 Japan .
61-14518 4/1986 Japan .
63-42288 8/1988 Japan .
1-200289 8/1989 Japan .

*Primary Examiner*—Stanley J. Witkowski
*Assistant Examiner*—H. Kim
*Attorney, Agent, or Firm*—Spensley Horn Jubas & Lubitz

[57] ABSTRACT

A desired offset value is set and difference between this offset value and touch data is obtained. A touch response control is performed in either of positive and negative directions. This difference data may be changed and adjusted by a desired touch sensitivity parameter. In a case where data used for a tone control is transferred from suitable reference data to control data corresponding to touch data, following interpolation from the reference data to the control data is made and a tone control is made in response to data obtained by this interpolation. In this case, coefficients for the following interpolation are caused to change gradually so that tone control data obtained by the interpolation will change smoothly. An abrupt change in a tone control signal thereby can be prevented and a touch response control which is not accompanied by unnaturalness can be realized.

15 Claims, 12 Drawing Sheets

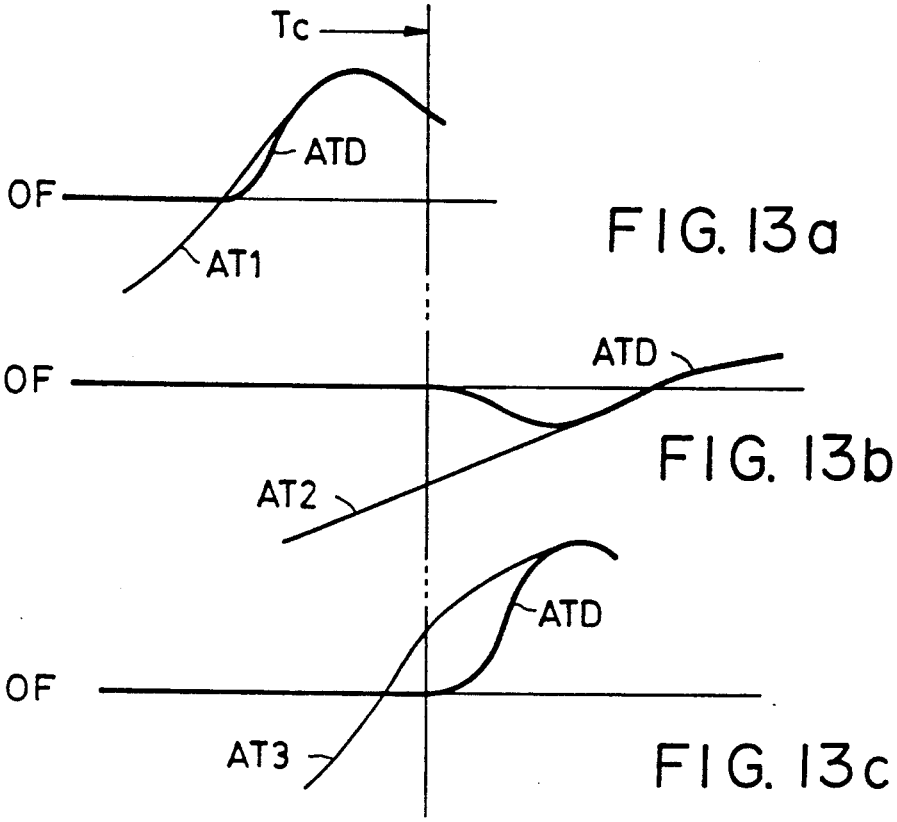
FIG. 13a
FIG. 13b
FIG. 13c
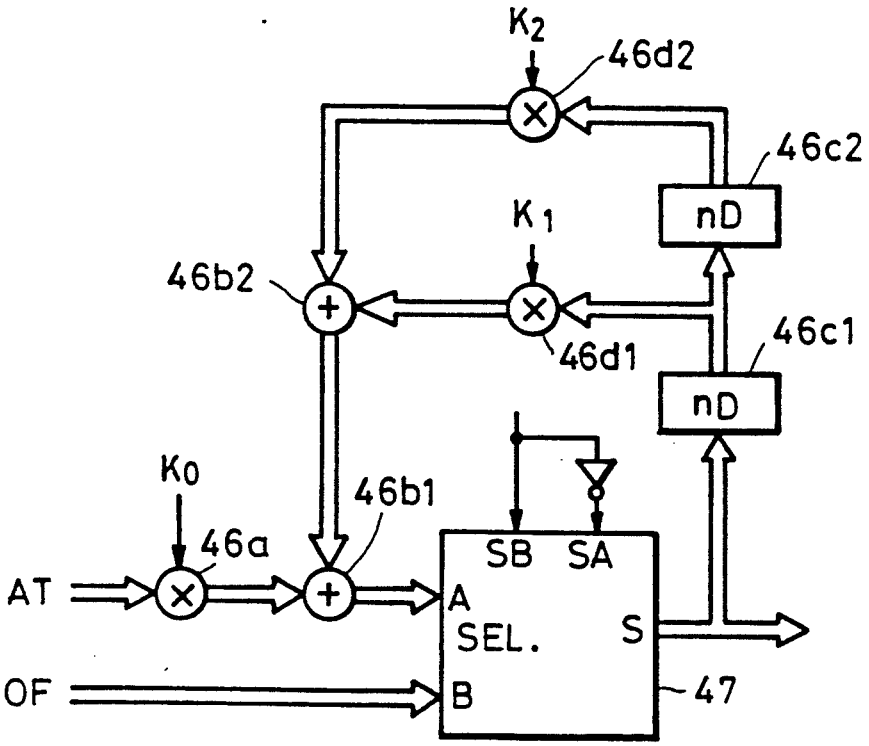
FIG. 15

ELECTRONIC MUSICAL INSTRUMENT CAPABLE OF CONTROLLING TOUCH RESPONSE BASED ON A REFERENCE VALUE

BACKGROUND OF THE INVENTION

This invention relates to a touch response device for an electronic musical instrument and, more particularly, to a touch response device of an improved touch control system for controlling tone color, tone pitch, tone volume etc. of a tone in response to an operation touch during performance of operation means such as keys in a keyboard instrument.

There are an initial touch control which controls tone color, tone pitch, tone volume etc. of a tone in response to key depression speed and an after touch control which controls tone color etc. of a tone by detecting a key depression force during sustaining of key depression. As a prior art of this touch response control, there are techniques disclosed in Japanese Patent Publication No. 61-14518 corresponding to U.S. Pat. No. 4,301,704 and Japanese Preliminary Patent Publication No. 1-200289 corresponding to U.S. Pat. No. 4,979,423. U.S. Pat. No. 4,301,704 discloses a touch response control which is made in accordance with initial touch data which is formed by detecting a difference between operation times of two contacts produced in accordance with key depression speed and after touch data which is formed in response to a detection signal from pressing force detection devices consisting of a piezoelectric element and provided for respective keys of a keyboard. U.S. Pat. No. 4,979,423 discloses a touch response control according to which pressing force detection devices producing first and second detection signals of mutually different output response characteristics depending upon key depression force are provided for respective keys of a keyboard and the first detection signal is used as an initial touch signal and the second detection signal is used as an after touch signal. As other prior art concerning the touch response control, there are techniques disclosed in Japanese Preliminary Patent Pubication No. 59-105692 and Japanese Patent Publication No. 52-46088 corresponding to U.S. Pat. No. 3,882,751.

Japanese Patent Publication No. 63-42268 corresponding to U.S. Pat. No. 4,528,885 discloses a control according to which, in order to enable a touch response control to be made from a time point immediately after depression of a key even when rising of an after touch detection signal has been delayed, there is formed a tone control signal which gradually changes toward an initial touch signal which is a target value during a predetermined period of time from start of depression of a key and changes thereafter following an after touch signal, and a tone is controlled in accordance with this tone control signal. In this control, for enabling the tone control signal which has once reached a target value corresponding to an initial touch signal to follow an after touch signal thereafter, one of two following coefficients is selectively used depending upon whether the current value of the tone control signal is larger or smaller than the current value of the after touch signal. More specifically, when the current value of the tone control signal is larger than the current value of the after touch signal, a first following coefficient having a negative inclination is used, whereas when the current value of the tone control signal is smaller than the current value of the after touch signal, a second following coefficient having a positive inclination is used. Accordingly, when the current value of the tone control signal is larger than the current value of the after touch signal, the tone control signal changes with a certain negative inclination corresponding to the first following coefficient and, thereafter, as the current value of the tone control signal becomes smaller than the current value of the after touch signal, the tone control signal changes with a certain positive inclination corresponding to the second following coefficient.

In all of the after touch control techniques described in the above prior art publications, a state in which a pressing force against the pressing force detection devices is zero (i.e., a state in which no after touch signal is produced) is used as a reference, and tone volume, tone pitch, tone color, tonal effects etc. are increased or decreased in a positive direction (a direction in which the output value is larger than a normal output value produced in a case where the after touch control is not made) or in a negative direction (a direction in which the output value is smaller than a normal output value produced in a case where the after touch control is not made) with respect to the output value of the after touch signal in accordance with the magnitude of an absolute output value of the after touch signal. Thus, the prior art after touch control is made in only one of the positive and negative directions from the normal output value of tone volume, tone pitch, tone color, tonal effect etc. of a tone which is used as a borderline.

In natural musical instruments such as violin, tone volume and tone pitch after sounding of a tone can be increased or decreased in either positive or negative direction as desired by the player. In the above described prior art electronic musical instruments, however, the touch control can be made only in one direction, so that it is not possible to increase or decrease tone volume, tone pitch etc. as freely as in natural musical instruments and performance expression by the electronic musical instruments therefore is inferior to that of natural musical instruments.

SUMMARY OF THE INVENTION

It is, therefore, a first object of the invention to provide a touch response device for an electronic musical instrument capable of performing a touch control in either of positive and negative directions.

It is a second object of the invention to provide a touch response device for an electronic musical instrument which, in performing a touch control, is capable of freely changing a touch sensitivity in response to touch sensitivity parameters.

It is a third object of the invention to provide a touch response device for an electronic musical instrument which, in a case where a tone control signal which has been intitially set at a certain value is thereafter changed to a signal following an after touch signal and a tone control is made in response to this tone control signal, is capable of performing a touch response control in such a manner that an abrupt change of the tone control signal can be prevented and thereby impression of unnaturalness can be prevented.

For achieving the first object of the invention, the touch response device for an electronic musical instrument according to the invention comprises a performance operation section for making performance operation for a tone, a touch data generation section for detecting an operation touch applied during operation of the performance operation section and generating touch data in response to the detected operation touch, a reference value generation section for generating a desired reference value, a control data generation section for obtaining a difference between the reference value and the touch data and generating control data in response to this difference, and a tone control section for controlling a tone in response to the control data.

The reference value represents a reference of magnitude of touch data. In the following description of preferred embodiments, a term "offset value" is used as a value corresponding to the reference value. The difference between this reference value and touch data is obtained, the control data is generated in response to the difference and the touch response control is performed for a tone in response to this control data. When, for example, the touch data is larger than the reference value, i.e., offset value, difference data is a positive value and tone elements such as tone volume, tone pitch, tone color and tonal effects are increased or decreased in a positive direction in accordance with the magnitude of this difference. Conversely, when the touch data is smaller than the reference value, i.e., offset value, the difference data is a negative value and tone elements such as tone volume, tone pitch, tone color and tonal effects are decreased or increased in a negative direction in accordance with the magnitude of the difference data. Therefore, according to the invention, the touch response control capable of performing increasing or decreasing tone elements such as tone volume, tone pitch, tone color and tonal effects in either of positive and negative directions is achieved.

For achieving the second object of the invention, said control data generation section of the touch response device comprises an operation section for obtaining a difference between the reference value and the touch data and a sensitivity adjusting section for adjusting the difference data obtained by the operation section by a desired touch sensitivity parameter and providing the adjusted difference data as the control data. Since the difference data obtained by the operation section can be adjusted by a desired touch sensitivity parameter according to tone pitch, tone color etc. of a tone to be generated, touch sensitivity can be subtly adjusted by the tone color or key scaling, so that a performance which is rich in expression can be performed even by a beginner.

For achieving the third object of the invention, the touch response device for an electronic musical instrument comprises a performance operation section for making performance operation of a tone, a control data generation section for detecting an operation touch applied during operation of the operation section and providing, as first control data, data which changes in response to the detected operation touch, a reference data generation section for generating reference data, a transfer instruction section for instructing for a transfer of data used for tone control from the reference data to the first control data, an interpolation control section for performing, when said transfer has been instructed, following interpolation from the reference data to the first control data and providing data obtained by the interpolation as second control data, a coefficient change control section for changing coefficient of the following interpolation and thereby enabling the second control data to change smoothly, and a tone control section for controlling a tone in response to the second control data.

The first control data changes in response to the operation touch applied during operation of the operation section, i.e., after touch. Upon designation of transfer of data used for the tone control from the reference data to the first control data, the following interpolation is made by the interpolation control section and data which gradually changes from the reference data to the first control data is provided as the second control data. The coefficient used during the following interpolation is not a constant value as in the prior art devices but is caused to change gradually by the coefficient change control section and the second control data thereby is controlled to smoothly change from the reference data to the first control data. The tone is controlled in response to the second control data obtained by the following interpolation. The second control data, i.e., tone control signal, therefore changes smoothly from the reference data to the first control data whereby abrupt change of a tone control signal is prevented and a touch response control which is not accompanied by unnaturalness can be achieved. The reference data corresponds to a start value of following interpolation. In the description of a modified embodiment, the offset value data corresponds to the reference data. As the reference data corresponding to the start value of the following interpolation, not only above described offset value data but other data, e.g., initial touch data, may be used.

Preferred embodiments of the invention will be described below with reference to the accompanying drawings.

BRIEF DESCRIPTION OF THE DRAWINGS

In the drawings,

FIGS. 13*a* to 13*c* are diagrams showing an example of the relation between the output waveform of the after touch data and the offset value in its essential portion in an enlarged scale for describing the operation of the embodiment of FIG. 12;

FIG. 15 is a block diagram showing a modified example of the circuit portion for following interpolation in FIG. 14.

DETAILED DESCRIPTION OF PREFERRED EMBODIMENTS

Figure 1:
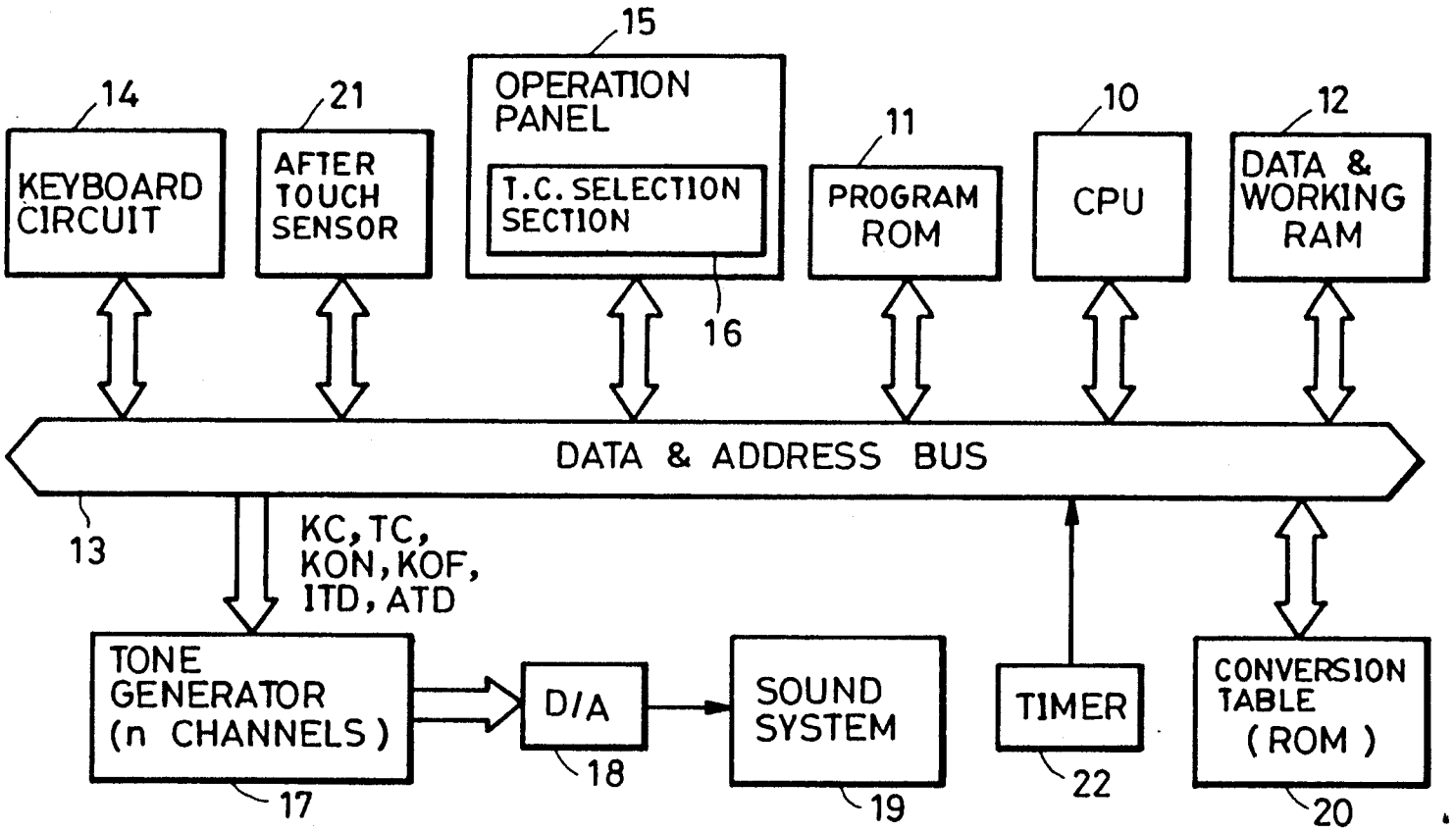
FIG. 1 is a block diagram showing a hardware construction of an embodiment of the electronic musical instrument according to the invention.

In the embodiment of FIG. 1, the control of the entire electronic musical instrument is made by a microcomputer including a microprocessor (CPU) 10, a ROM microcomputer including a microprocessor (CPU) 10, a ROM 11 storing a system program and a data and working RAM 12 storing various data and being used as a working RAM. To this microcomputer are connected various devices including a keyboard circuit 14, an operation panel 15 and a tone generator 17 constituting a tone source through a data and address bus 13. These devices are controlled by the microcomputer.

The keyboard circuit 14 includes a circuit having plural key switches provided in correspondence to keys in a keyboard designating tone pitches of tones to be generated. A depressed key detecting processing and a key assigning processing for assigning a depressed key to any of plural tone generation channels are performed by the microcomputer in response to an output of this keyboard circuit 14. When necessary, a processing for detecting the key depression speed and thereby producing initial touch data ITD is also performed. There is also provided an after touch sensor 21 for detecting a key depressing force during sustaining of key depression and thereby producing after touch data.

The operation panel 15 includes various operators for selecting, setting and controlling tone color, tone volume, tone pitch and tonal effects and has a tone color selection section 16 for selecting tone colors corresponding to various natural musical instruments such as piano, organ, violin, brass and guitar and various other tone colors.

A conversion table 20 is made of a ROM storing various data including, e.g., an offset coefficient for variably controlling an offset value OF in response to a key code as will be described later.

A tone generator 17 can generate tone signals simultaneously in n channels. The tone generator 17 inputs key codes KC assigned to respective channels, a key-on signal KON, a key-off signal KOF, initial touch data ITD, after touch data ATD, a tone color selection signal TC and other data supplied through the data and address bus 13 and generates a tone signal in response to these various data. In this embodiment, the number of channels in which tone signals can be generated simultaneously is set at 16.

Any method may be employed for generating a tone signal in the tone generator 17. Such methods include known methods, e.g., a memory reading system according to which tone waveform sample value data stored in a waveform memory is successively read out in response to address data which changes according to the tone pitch of a tone to be generated, an FM system according to which tone waveform sample value data is obtained by executing a predetermined frequency modulation operation using the address data described above as phase angle parameter data, and an AM system according to which tone waveform sample value data is obtained by executing a predetermined amplitude modulation operation using the address data as phase angle parameter data.

A digital tone signal generated by the tone generator 17 is converted to an analog tone signal by a digital-to-analog converter 18 and supplied to a sound system 19.

The sound system 19 is composed of components including a loudspeaker and an amplifier and generates a tone corresponding to the analog tone signal from the digital-to-analog converter 18.

A timer 22 supplies an interrupt signal to the microcomputer periodically. In this embodiment, the after touch data processing is executed by the timer interrupt signal.

The general concept of the after touch control in this invention will now be described with reference to FIGS. 2a and 2b.

Figure 2A:
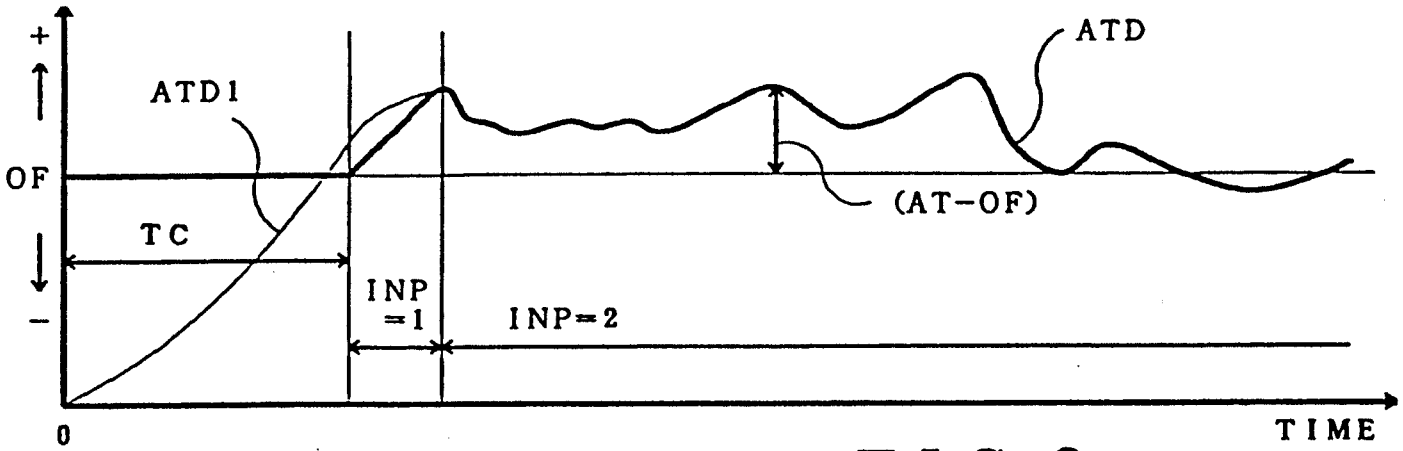
FIGS. 2*a* and 2*b* are diagrams showing the relation between the output waveform of after touch data and the offset value for describing the operation of the embodiment of FIG. 1.
Figure 2B:
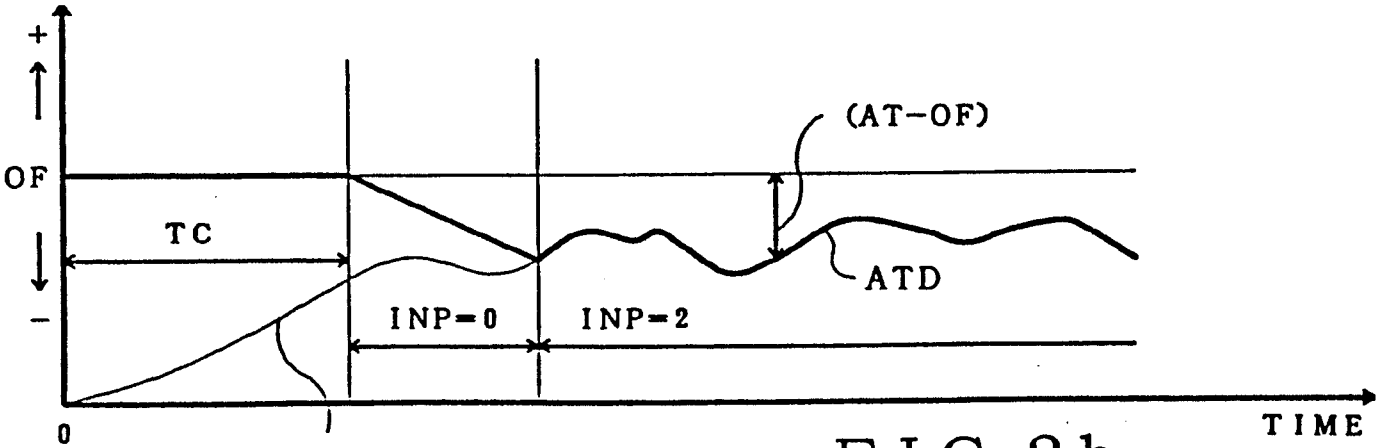

FIGS. 2a and 2b show the relationship between an output waveform of after touch data during depression of any selected key and its offset value OF. In the figures, the time point at which depression of the key starts is 0.

FIG. 2a shows a case in which after touch data ATD1 is larger than the offset value OF at a time point at which a predetermined time length Tc has elapsed after start of key-on, whereas FIG. 2b shows a case in which after touch data ATD2 is smaller than the offset value OF at the same time point.

In the cases of FIGS. 2a and 2b, it is assumed that no after touch data is produced until the predetermined time length Tc has elapsed. In other words, the after touch control is not performed until the predetermined time length Tc has elapsed. This predetermined time Tc may be a brief length of time prior to a time point at which the depressed key has reached the lowermost position. This time length Tc is set for providing a standby time until a real after touch detection output is obtained from the after touch sensor 21.

Upon lapse of a certain length of time, the after touch data ATD1 and ATD2 are compared with the offset value OF and a difference value, i.e., value (AT−OF) obtained by subtracting the offset value OF from the after touch data ATD, is supplied to the tone generator 17 as data for controlling after touch. Therefore, in the case of FIG. 2a in which the after touch data ATD is larger than the offset value OF, the difference value is provided as a positive value whereas in the case of FIG. 2b in which the after touch data ATD is smaller than the offset value OF, the difference value is provided as a negative value. Accordingly, the tone generator 17 can increase or decreace tone volume, tone pitch, tone color, and tonal effects of a tone either in a positive direction or in a negative direction of a normal output value by the positive or negative difference value.

As shown in FIGS. 2a and 2b, since, in most cases, the after touch data ATD1 or ATD2 is larger or smaller than the offset value OF at the time point at which the predetermined time length Tc has elapsed, the difference value (AT−OF) is not provided immediately as after touch data in the present invention but, instead, an interpolation processing is performed for causing the difference value to approach the real after touch data ATD gradually by an interpolation operation.

In the figures, INP designates contents of an interpolation register. When the after touch data ATD1 is larger than the offset value OF as shown in FIG. 2a, "1" is stored in the register INP whereby a mode in which an upward interpolation is performed is brought about. When the after touch data ATD2 is smaller than the offset value OF as shown in FIG. 2*b*, "0" is stored in the register INP whereby a mode in which a downward interpolation is performed is brought about. Upon completion of the interpolation processing, "2" is stored in the register INP whereby a mode in which no interpolation is performed at all is brought about and the difference value (AT−OF) is directly supplied.

An example of processing executed by the microcomputer will now be described with reference to flow charts of FIGS. 3, 4 and 5.

Figure 3:
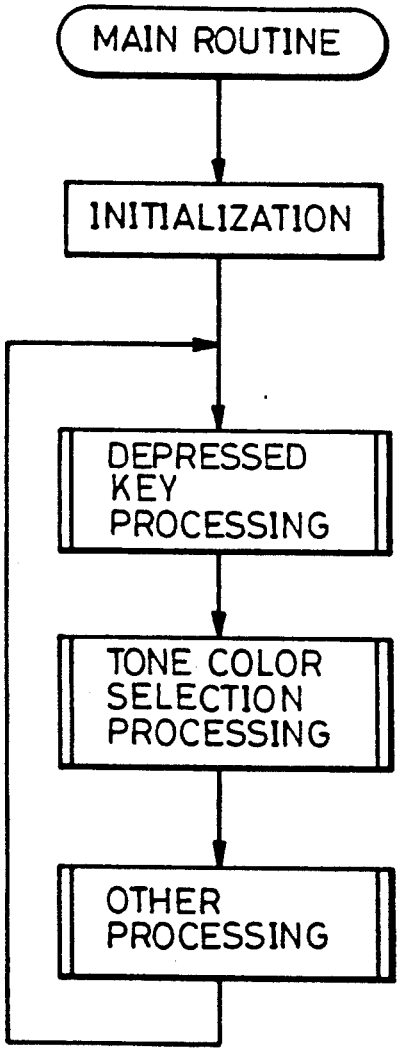
FIG. 3 is a flow chart showing an example of a main routine processed by a microcomputer of FIG. 1.

FIG. 3 shows an example of a main routine executed by the microcomputer.

Figure 6:
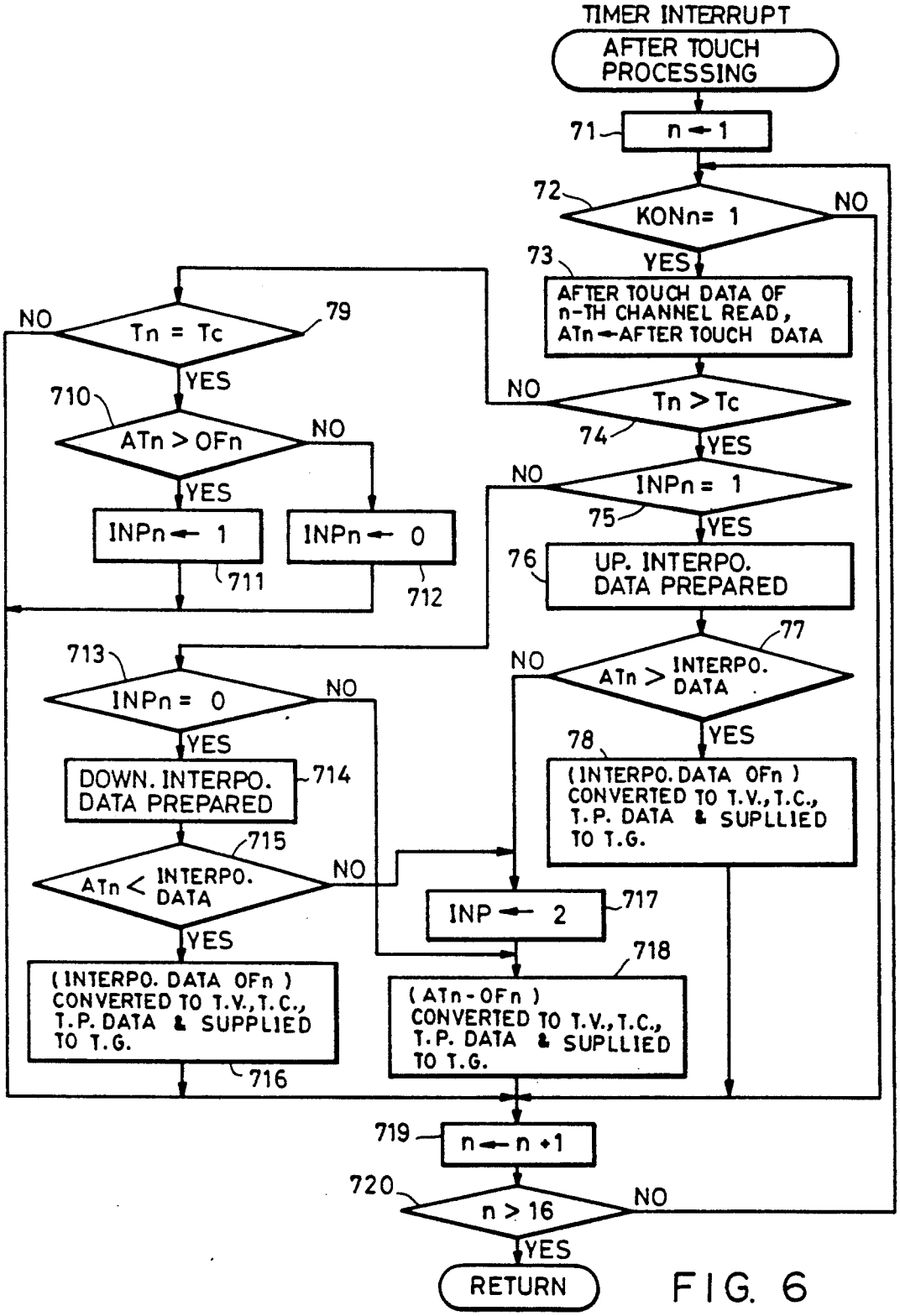
FIG. 6 is a flow chart showing a specific example of the after touch processing routine executed by timer interrupt.

In "initialization", predetermined values are set in all data of the microcomputer upon turning on of the power switch. Thereafter, "depressed key processing routine", "tone color selection processing routine" and other various processings are repeatedly executed. When an interrupt signal is given from the timer 22 during this main routine, the after touch processing shown in FIG. 6 is executed by the timer interrupt.

In "depressed key processing routine", the depressed key detection processing and key assigning processing are performed in response to the output of the keyboard circuit 14. An example of this processing is shown in FIG. 4.

In "tone color selection processing routine", a tone color selection processing is performed when the tone color selection is made on the tone color selection section 16 of the operation panel 15. An example of this processing is shown in FIG. 5.

In "other processing routine", processings based on operation of other operators on the operation panel 15 and other various processings are performed.

Figure 4:
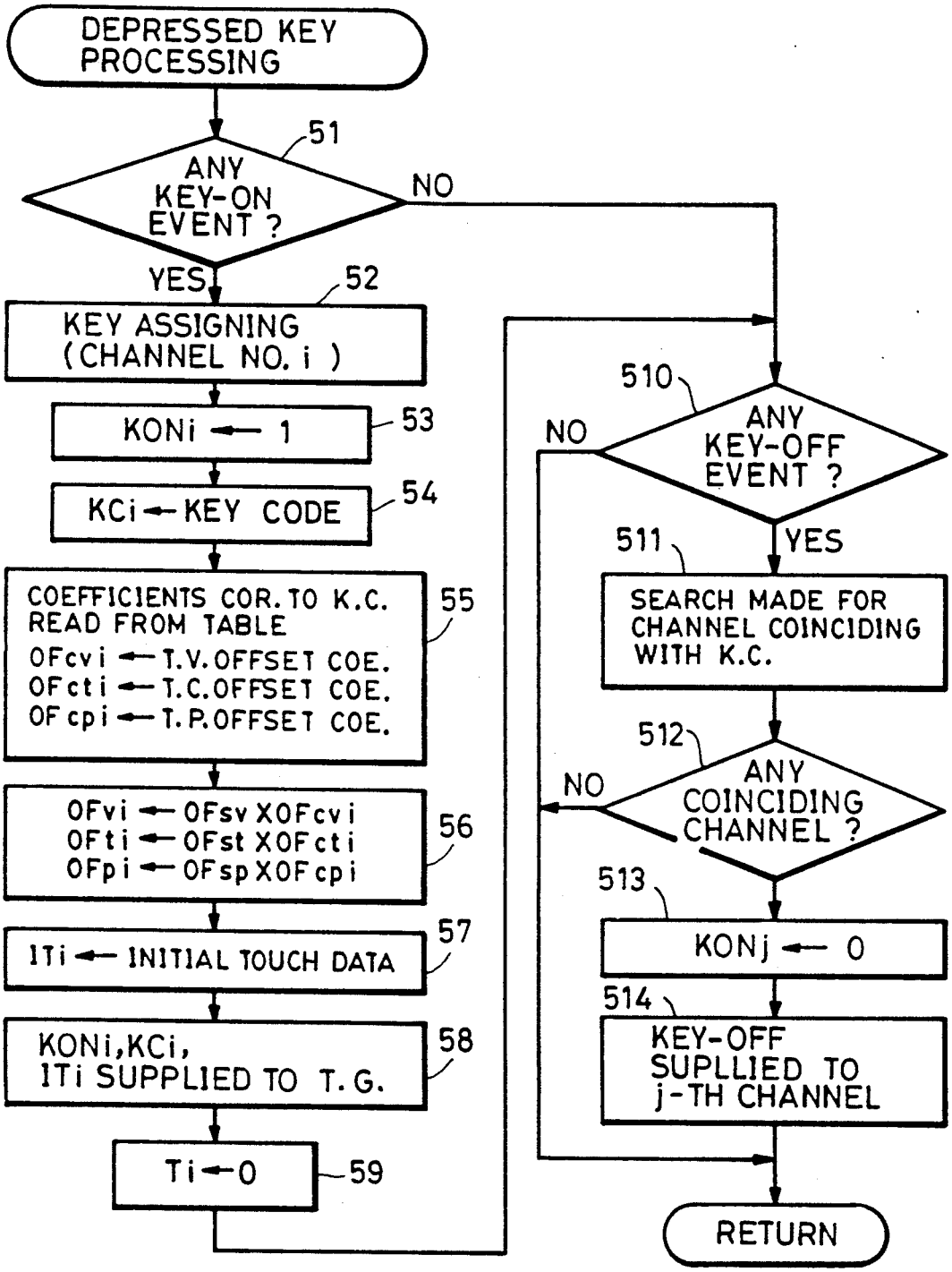
FIG. 4 is a flow chart showing a specific example of the key depression processing routine of FIG. 3.

Referring now to FIG. 4, contents of processings of respective steps of "depressed key processing routine" will be described in the order of the processing.

Step 51

Respective key switches in the keyboard circuit 14 are scanned to detect the presence or absence of a key-on event. When a key has been depressed, a key-on event is detected and when a key has been released, a key-off event is detected. When the key-on event is present (YES), the routine proceeds to the next step 52. When the key-on event is absent (NO), the routine proceeds to step 510.

Step 52

A key assigning processing is executed in accordance with the result of the key scanning in step 51. That is, a channel to which tone generation of a newly determined depressed key should be assigned is determined and this channel is designated by a channel number i.

Step 53

A signal "1" is set in a key-on register KONi corresponding to the channel number i of the channel designated in step 52. The CPU 10 can thus recognize that the key which has been assigned to the channel number i is being depressed.

Step 54

The key code of the newly depressed key which has been assigned in step 52 is stored in a key buffer KCi corresponding to the channel number i.

Step 55

Offset coefficients corresponding to the key code which has been stored in the key buffer KCi in step 54 are read from the conversion table 20 and are stored in offset coefficient registers OFcvi, OFcti and OFcpi for tone volume, tone color and tone pitch corresponding to the channel number i.

Figure 7:
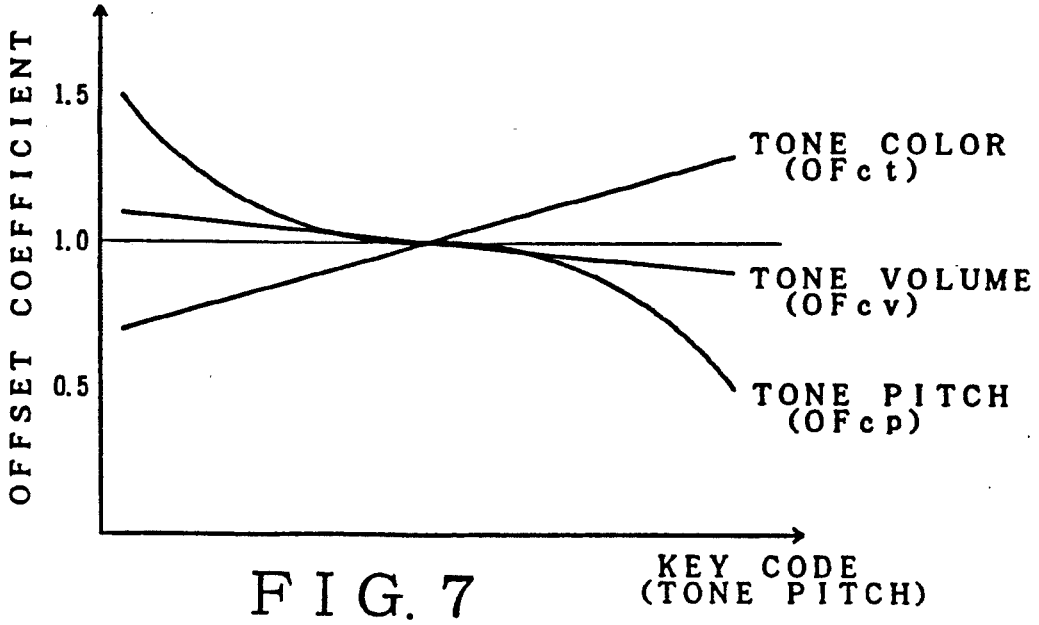
FIG. 7 is a diagram showing an example of a key scaling table of offset coefficients stored in the conversion table of FIG. 1.

The conversion table 20 stores key scaling values of the respective offset coefficients for tone volume, tone color and tone pitch. An example of each of the three types of offset coefficients stored in the conversion table 20 is shown in FIG. 7. In this example, the tone volume offset coefficient OFcv is a value which decreases as the key code becomes a larger value (the tone becomes higher) (i.e., proportion constant depends upon negative primary function). The tone color offset coefficient OFct is a value which increases as the key code becomes a larger value (becomes a higher tone) (i.e., proportion constant depends upon positive primary function). The tone pitch offset cofficient OFcp is a value which increases in the manner of a secondary function as the key code becomes a smaller value (the tone becomes a lower tone) and decreases in the manner of a secondary function as the key code becomes a larger value (the tone becomes a higher tone). In other words, in the case of tone pitch, the offset coefficient is made higher on the lower tone side to facilitate lowering of the tone pitch and the offset coefficient is made lower on the higher tone side to facilitate raising the tone pitch. By this arrangement, a control for more closely simulating a natural musical instrument can be achieved.

The tone volume offset coefficient register OFcv, tone color offset coefficient register OFct and tone pitch offset coefficient register OFcp are provided for each channel. Accordingly, tone volume offset coefficients, tone color offset coefficients and tone pitch offset coefficients corresponding to the respective key codes are stored in the offset coefficient registers OFcvi, OFcti and OFcpi assigned to the channel number i among the offset coefficient registers OFcv, OFct and OFcp.

By preparing plural offset coefficient tables as shown in FIG. 7 for plural types of musical instruments, i.e., plural tone colors, a natural musical instrument can be more closely simulated. A control for more closely simulating a natural musical instrument can be attained by setting the offset coefficient at a high value as a whole to facilitate lowering of the tone pitch in the case of, e.g., trumpet, and by setting the offset coefficient at a low value as a whole to facilitate raising of the tone pitch in the case of, e.g., violin.

Step 56

Reference offset values for tone volume, tone color and tone pitch stored in reference offset value registers OFsv, OFst and OFsp are multiplied with the values stored in the offset coefficient registers OFcvi, OFcti and OFcpi and results are stored in a tone volume offset value register OFvi, a tone color offset value register OFti and a tone pitch offset value register OFpi respectively of the channel number i.

Step 57

Initial touch data ITD is computed and stored in an initial touch data register ITi of the corresponding channel number i.

Step 58

The data stored in the key-on register KONi, key buffer KCi and initial touch data register ITi are supplied to the tone generator (i.e., tone source) 17. Responsive to these data, the tone generator 17 generates a tone signal of a tone pitch corresponding to the key code of the key buffer KCi in the channel number i.

Step 59

The time measuring counter Ti is reset and measuring of time elapsed after key-on is started.

Step 510

In a case where absence of a key-on event has been detected in step 51 or in a case where the processing of step 59 has been completed, the routine proceeds to this step 510. In this step, the presence or absence of a key-off event is detected. When there is no key-off event (NO), the processing is ended and the routine jumps to return. When there is a key-off event (YES), the routine proceeds to the next step 511.

Step 511

A search is made for a channel to which a key code coinciding with the key code for which the key-off event has occurred is assigned.

Step 512

Whether or not there is a channel which coincides with the key code for which the key-off event has occurred is detected as a result of the search made in step 511. When there is no corresponding channel, this step is ended and the routine jumps to return. When there is a corresponding channel, the routine proceeds to next step 513.

Step 513

A signal "0" is set in a key-on register KONj corresponding to the channel number j which has been detected by the search in step 511. The depression of the key which was assigned to the channel number j thereby is released and a key release state is indicated.

Step 514

A key-off signal is supplied to the j-th channel of the tone generator 17 thereby to bring about a tone generation decay mode after release of the key.

Figure 5:
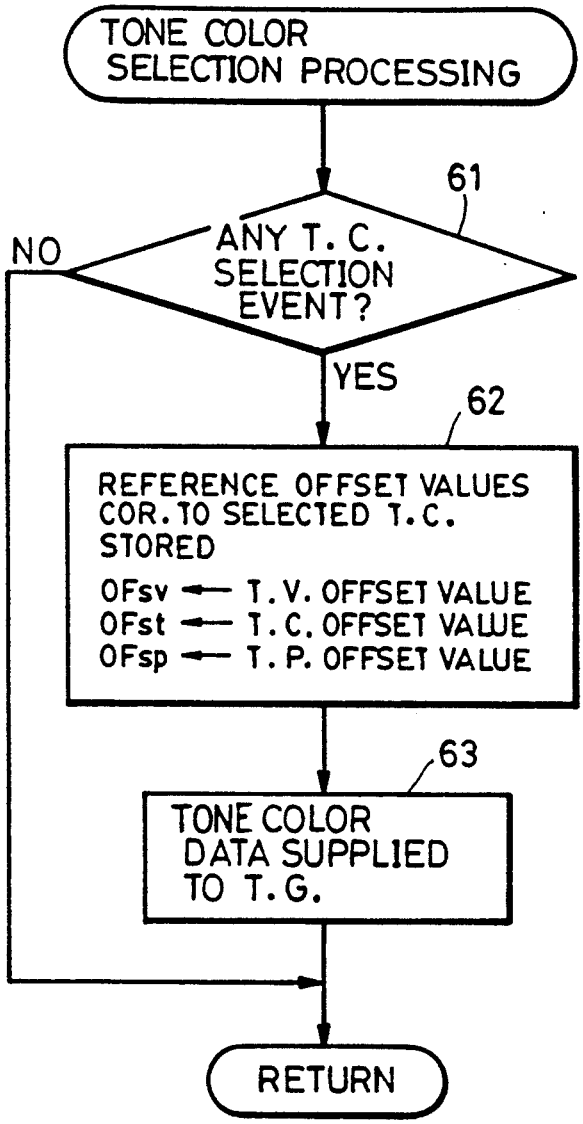
FIG. 5 is a flow chart showing a specific example of the tone color selection processing routine of FIG. 3.

Referring now to FIG. 5, contents of processings in respective steps of "tone color selection processing routine" will be described.

Step 61

Presence or absence of a tone color selection event is detected. This tone color selection event occurs when any tone color selection operation has been made in the tone color selection section 16. When there is the tone color selection event (YES), the routine proceeds to next step 62 whereas when there is no tone color selection event (NO), the routine jumps to return.

Step 62

When there has been a tone color selection event, reference offset values for tone volume, tone color and tone pitch corresponding to the selected tone color are read from the conversion table and stored in the reference offset value registers OFsv, OFst and OFsp for tone volume, tone color and tone pitch, respectively.

Step 63

Tone color data TC corresponding to the selected tone color is supplied to the tone generator 17.

FIG. 6 shows the after touch routine specifically. This routine is a processing executed every time an interrupt signal has been given from the timer 22.

Step 71

A signal "1" is set in a channel number reigster n.

Step 72

Whether or not "1" is set in the key-on register KONn corresponding to the channel number which is stored in the register n is detected. When "1" is set (YES), this state signifies that depression of the key which has been assigned to this channel is sustained. In this case, the routine proceeds to the next step 73 in which the after touch processing is executed. When "1" is not set (NO), this state signifies that the key has been released, so that it is not necessary to conduct the after touch processing and the routine therefore jumps to step 719 in which the channel number n is advanced.

Step 73

After touch data ATD of the key which has been assigned to the corresponding n-th channel is read out and stored in the after touch register ATn.

Step 74

The value of the time measuring counter Tn which represents time which has elapsed after release of the key for the n-th channel (corresponding to Ti in FIG. 4) is compared with the predetermined time length Tc and, when Tn is smaller than Tc (i.e., in the case of NO), the routine proceeds to step 79 and, when Tn is larger than Tc (i.e., in the case of YES), the routine proceeds to step 75.

Step 75

When the value of the time measuring counter Tn is larger than the predetermined time length Tc (i.e., the predetermined time length Tc has elapsed), whether or not the value of an interpolation mode registrer INPn of the particular channel is "1" is detected. When the value is "1" (YES), the routine proceeds to a step in which interpolation data is prepared in the upward interpolation mode. Otherwise, the routine proceeds to step 713.

Step 76

Interpolation data is prepared in the upward interpolation mode. Upward interpolation data is prepared by, for example, incrementing respective offset values read from the offset value registers OFvn, OFtn and OFpn (see FIG. 4, step 56) of the particular channel by 1 or a predetermined value in accordance with a predetermined interpolation function (e.g., linear interpolation function), using these offset values read from the offset value registers OFvn, OFtn and OFpn as initial values.

Step 77

Whether the prepared upward interpolation data is smaller than the value of the after touch data in the after touch register ATn or not is detected. When the upward interpolation data is smaller (YES), it signifies that the interpolation data has not reached the after touch data yet, so that the routine proceeds to step 78. When the upward interpolation data is larger than the after touch data (NO), it signifies that the interpolation data has reached the after touch data, so that the routine proceeds to step 717.

Step 78

Offset values of the offset value registers OFvn, OFtn and OFpn (these values are denoted representatively by OFn) are subtracted from the interpolation data for controlling tone volume, tone color and tone pitch prepared in step 76. The difference values (interpolation data minus OFn) are converted to respective data for controlling tone volume, tone color and tone pitch and supplied to the tone generator 17. Then, the routine proceeds to step 719. The difference values (interpolation data minus OFn) become positive values and, therefore, an after touch control for controlling tone volume, tone color and tone pitch in a positive direction can be performed.

Step 79

Whether or not the value of the time measuring counter Tn coincides with the predetermined time length Tc is detected. When Tn coincides with Tc (YES), the routine proceeds to step 710 in which the type of interpolation (i.e., upward or downward) is determined. When Tn has not reached Tc (NO), the routine jumps to step 719.

Step 710

Whether or not after touch data ATD in the after touch register ATn is larger than the offset value OFn is detected.

Step 711

When the after touch data ATD is larger than the offset value OFn, a high level signal "1" is set in the interpolation mode register INPn of the particular channel n for indicating that the type of interpolation is the upward interpolation and then step 719 is executed.

Step 712

When the after touch data ATD is smaller than the offset value OFn, a low level signal "0" is set in the interpolation mode register INPn for indicating that the type of interpolation is the downward interpolation and the routine proceeds to step 719.

Since there are three types of values (OFvn, OFtn and OFpn), i.e., tone volume, tone color and tone pitch, in the offset values OFn in this embodiment, the processings of the above described steps 710, 711 and 712 are executed with respect to the respective types of values and the interpolation mode register INPn stores interpolation mode for the respective values. Detailed description concerning the respective values however is omitted and description is representatively made with respect to only one system.

Step 713

Whether or not the value of the interpolation mode register INPn is "0" is detected. When the value is "0" (YES), i.e., the mode is the downward interpolation mode, the routine proceeds to step 718. Otherwise (i.e., in the case of NO), the routine proceeds to step 718.

Step 714

Downward interpolation mode data is prepared. Downward interpolation mode data is prepared by, for example, decrementing 1 or a predetermined value from the respective offset values read from the offset value registers OFvn, OFtn and OFpn of the particular channel, using these values as initial values.

Step 715

Whether or not the prepared downward interpolation data is larger than the value of after touch data in the after touch data register ATn is detected. When the interpolation data is larger than the after touch data (YES), it is meant that the interpolation data has not reached the after touch data yet and, therefore, the routine proceeds to step 716 whereas when the interpolation data is smaller than the after touch data, it is meant that the interpolation data has reached the after touch data and, therefore, the routine proceeds to step 717.

Step 716

Offset values of corresponding offset value registers OFvn, OFtn and OFpn (these values are representatively denoted by OFn) are subtracted from respective interpolation data for tone volume, tone color and tone pitch prepared in step 714 and difference values (interpolation data minus OFn) are converted to data for controlling tone volume, tone color and tone pitch and supplied to the tone generator 17. Then, the routine proceeds to step 719. Difference values (interpolation data minus OFn) become negative values and, therefore, an after touch control for controlling tone volume, tone color and tone pitch in a negative direction is performed.

Step 717

In this step, "2" is set in the interpolation mode register INPn and the routine proceeds to step 718. When the interpolation mode register INPn is "2", completion of the interpolation operation is signified.

Step 719

1 is added to the contents of the channel number register n and the channel number thereby is incremented by 1.

Step 720

Whether or not the incremented value of the register n is smaller than maximum channel number of 16 is detected. When the incremented value is smaller than the maximum channel number (NO), the routine returns to step 72 and the above described processings are performed with respect to the incremented channel number n. When the incremented value is larger than the maximum channel number (YES), it is signified that the after touch processing with respect to all channels has been completed and, therefore, the routine returns to the main routine.

In steps 75–78, 713–716 and 717–718 of FIG. 6, it is assumed that the interpolation mode is the same in the same channel for convenience of explanation. Since, however, independent offset values OFvn, OFtn and OFpn are actually used for controlling tone volume, tone color and tone pitch, the interpolation mode may differ for each of these offset values. For coping with this question, a program may be made so as to execute processings of steps 75–77, 713–715 and 717–718 with respect to each of these offset values OFvn, OFtn and OFpn. Illustration of these cases will be omitted.

In the above described embodiment, the objects of control by after touch are three tone elements of tone volume, tone color and tone pitch. The invention however is not limited to this but a similar control may be made about various effects such as vibrato. Alternatively, only one of the tone elements of tone volume, tone color and tone pitch may be taken up as the object of control by after touch. The respective tone elements may be controlled by common after touch data instead of controlling them individually by individual after touch data.

In the above described embodiment, the reference offset data is variably controlled by the offset coefficients. The control by the offset coefficients may however be omitted. Alternatively, instead of controlling by the offset coefficients, plural reference offset values may be stored in a table and these reference offset values may be selectively read out by key scaling. Alternatively further, plural offset coefficients and reference offset values may be prepared and they may be selected in a desired manner.

In the above described embodiment, parameters for setting the offset values are selected tone color type, key scaling and types of tone elements (tone volume, tone color, tone pitch etc.) which are the objects of control. Other factors may however be used as parameters. For example, parameters may be determined freely as desired by an operating person operating an operator.

The pattern of variable control of the offset coefficients by key scaling, i.e., the pattern of variable control of the offset values, is not limited to the one shown in FIG. 7 but may be determined as desired depending upon the type of musical instrument or by an operating person.

Description has been made about a case where offset values and offset coefficients stored in the conversion table are used. The offset values and offset coefficients are not limited to these but they may be obtained by a suitable computation operation.

Figure 8A:
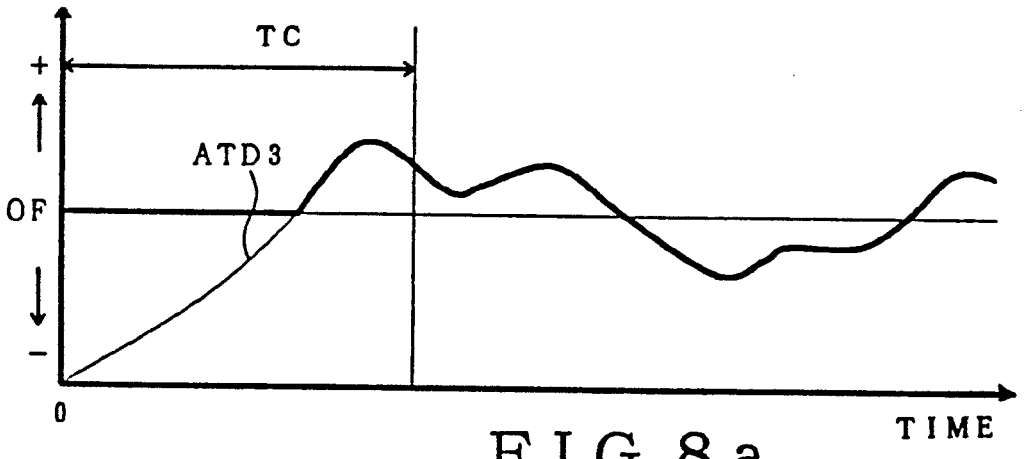
FIGS. 8*a* and 8*b* are diagrams showing another example of the after touch data processing.
Figure 8B:
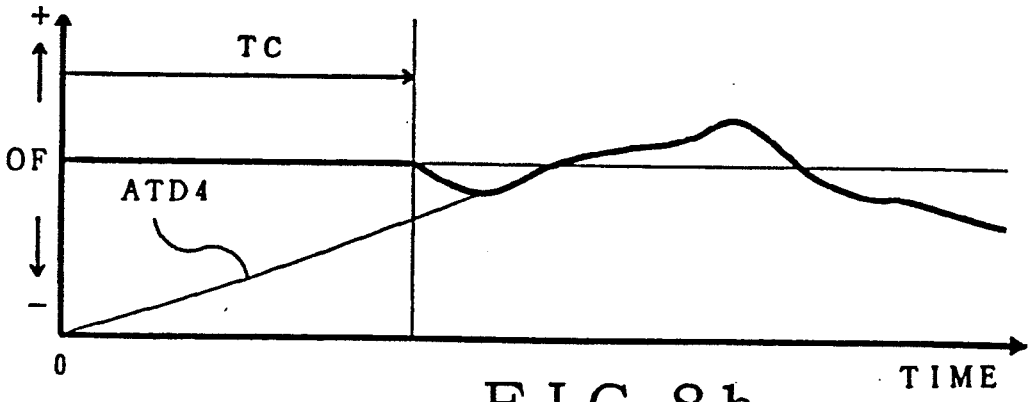

In the embodiment of FIG. 2, the after touch control is made after lapse of the predetermined time length Tc. Alternatively, as shown in FIG. 8*a*, the after touch control may be made from a time point when the after touch data has reached the offset value OF regardless of whether the time point is within the predetermined time length Tc or not. In this case, the above described interpolation operation is unnecessary. Further, in the embodiment of FIG. 2, the interpolation processing is made linearly. Alternatively, the interpolation curve may be made non-linear and, as shown in FIG. 8*b*, the output after lapse of the predetermined time length Tc may be gradually altered to connect smoothly to the after touch data. Further, in the embodiment of FIG. 2, the interpolation from the offset value to the after touch data is made after lapse of the predetermined time length Tc. Alternatively, transfer to the after touch data may be made upon lapse of the predetermined time length Tc without performing the interpolation.

Further, the invention may be carried out in synchronism with the timing of the tone generator 17 (e.g., sounding of a tone) without counting the predetermined time length Tc.

Referring to FIGS. 9 to 11*c*, another embodiment of the invention will be described.

Figure 9:
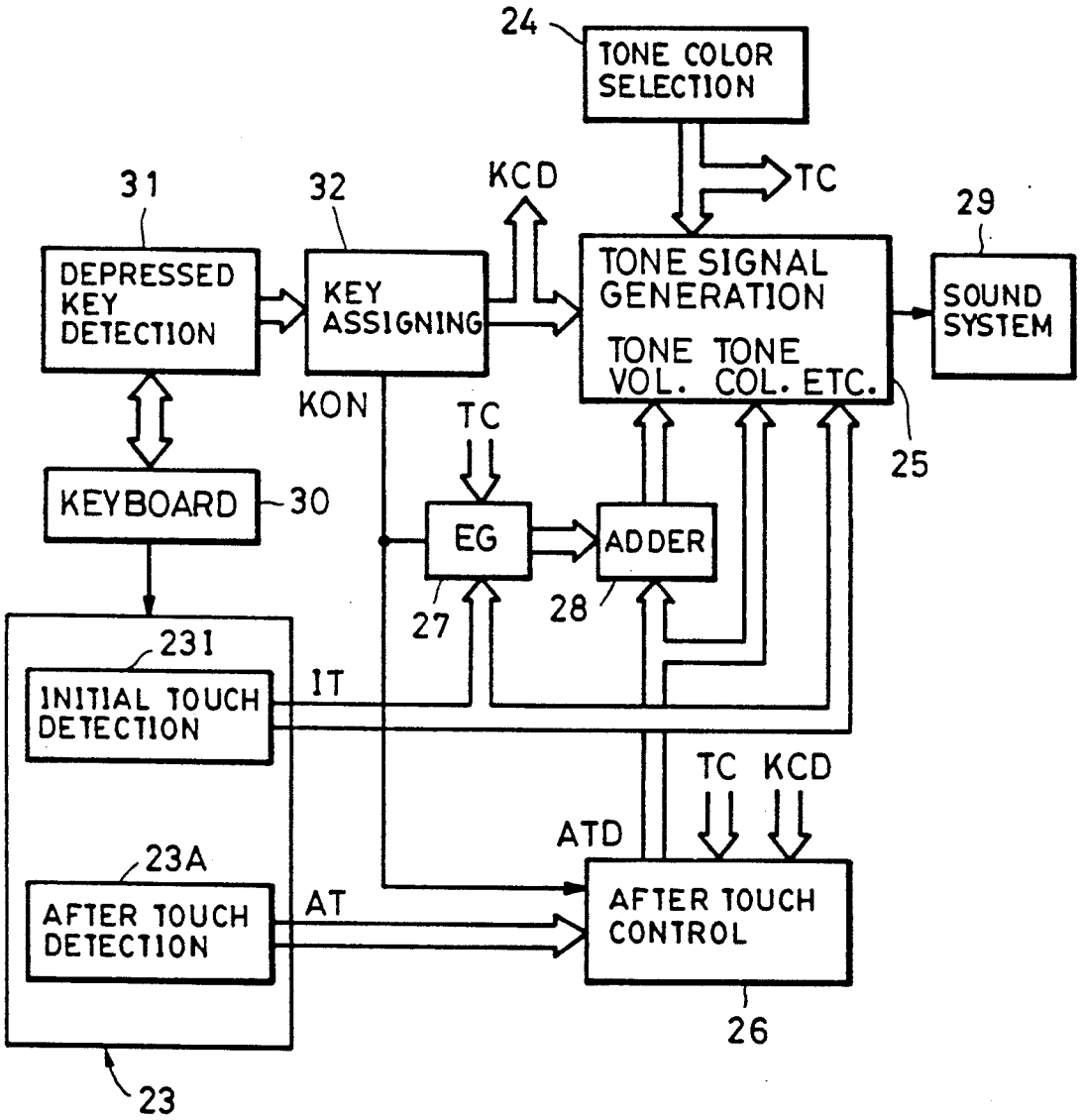
FIG. 9 is a block diagram showing the entire construction of another embodiment of the electronic musical instrument according to the invention.

In FIG. 9, a keyboard 30 includes keys for selecting tone pitch of a tone to be generated and key switches and key depressing force detection devices provided for respective keys.

A depressed key detection circuit 31 detects the state of the keyboard 30 (whether there is a depressed key or not), i.e., on-off states of the respective key switches in the keyboard 30. The depressed key detection circuit 31 is constructed, for example, of a scanning circuit scanning the respective key switches sequentially and a circuit for encoding the result of scanning.

A key assigning circuit 32 performs a processing for assigning generation of a tone corresponding to the depressed key which has been detected by the depressed key detection circuit 31 to any of tone generation channels of a predetermined number n. The key assigning circuit 32 generates a key code KCD for a key assigned to any of the channels and a key-on signal KON on a time shared basis with respect to each channel. The generated key code KCD is supplied to a tone signal generation circuit 25 and an after touch control circuit 26 and the key-on signal KON is supplied to an envelope generation circuit (EG) 27 and an after touch control circuit 26.

A touch detection circuit 23 detects touch of a key depressed in the keyboard 30 and produces touch information corresponding to the detected touch. The touch detection circuit 23 includes an initial touch detection circuit 231 which detects the key operating speed during depression of the key in response to the output from the key switch and thereupon produces initial touch data IT and an after touch detection circuit 23A which detects the key depressing force from the output of the key depressing force detection device during sustaining of key depression and produces after touch detection data AT.

The initial touch data IT of the initial touch detection circuit 231 is supplied to the envelope generation circuit 27 and the tone signal generation circuit 25 and the after touch detection data At of the after touch detection circuit 23A is supplied to the after touch control circuit 26.

A tone color selection circuit 24 is provided for selecting one of the tone colors of natural musical instruments such as piano, organ, violin, brass and guitar and other various tone colors. The tone color selection circuit 24 supplies a tone color selection signal TC representing a selected tone color to the tone signal generation circuit 25, after touch control circuit 26 and envelope generation circuit 27.

The after touch control circuit 26 inputs the key-on signal KON, after touch detection data AT, tone color selection signal TC and key code KCD and produces after touch data ATD in response to these signals and supplies this after touch data ATD to an adder 28 and the tone signal generation circuit 25. Details of the after touch control circuit 26 will be described later.

The envelope signal generation circuit 27 inputs the tone color selection signal TC, key-on signal KON, key-off signal KOF and initial touch data IT and produces an envelope shape signal corresponding to these signals at a timing of the key-on signal KON and supplies the envelope shape signal to the adder 28. The adder 28 adds the after touch data ATD to the envelope shape signal and supplies a sum signal to the tone signal generation circuit 25.

The tone signal generation circuit 25 can generate tone signals simultaneously in n channels. The tone signal generation circuit 25 inputs the key code KC of the keys which have been assigned to the respective channels, key-on signal KON, key-off signal KOF, initial touch data ITD, after touch data ATD, tone color selection signal TC and other data supplied through the data and address bus and generates tone signals in response to these data. In this embodiment, the channel number n in which tones can be generated simultaneously is set at 16.

As will be described later, the after touch data ATD can be varied in positive and negative directions on the basis of an offset value. In an adder 28, the level of the envelope shape signal is increased or decreased in accordance with the after touch data ATD. The increased or decreased envelope shape signal is used in the tone signal generation circuit 25 for, e.g., controlling tone volume of the generated tone. The after touch data ATD which has been directly applied to the tone signal generation circuit 25 is used suitably, for example, for changing the tone pitch of the generated tone subtly to a higher or lower side, or altering the tone color of the generated tone subtly from the reference tone color of a selected tone color in a positive or negative direction, or altering control factors of various effects subtly in a positive or negative direction.

Any method may be used as a tone signal generation method employed in the tone signal generation circuit 25. Such methods include known methods, e.g., the memory reading system, FM system and AM system which have been described with respect to the first embodiment. The digital tone signal generated in the tone signal generation circuit 25 is converted to an analog signal by a digital-to-analog converter (not shown) and supplied to a sound system 29. The sound system 29 is composed of components including a loudspeaker and an amplifier and generates a tone corresponding to the analog tone signal from the tone signal generation circuit 25.

Figure 10:
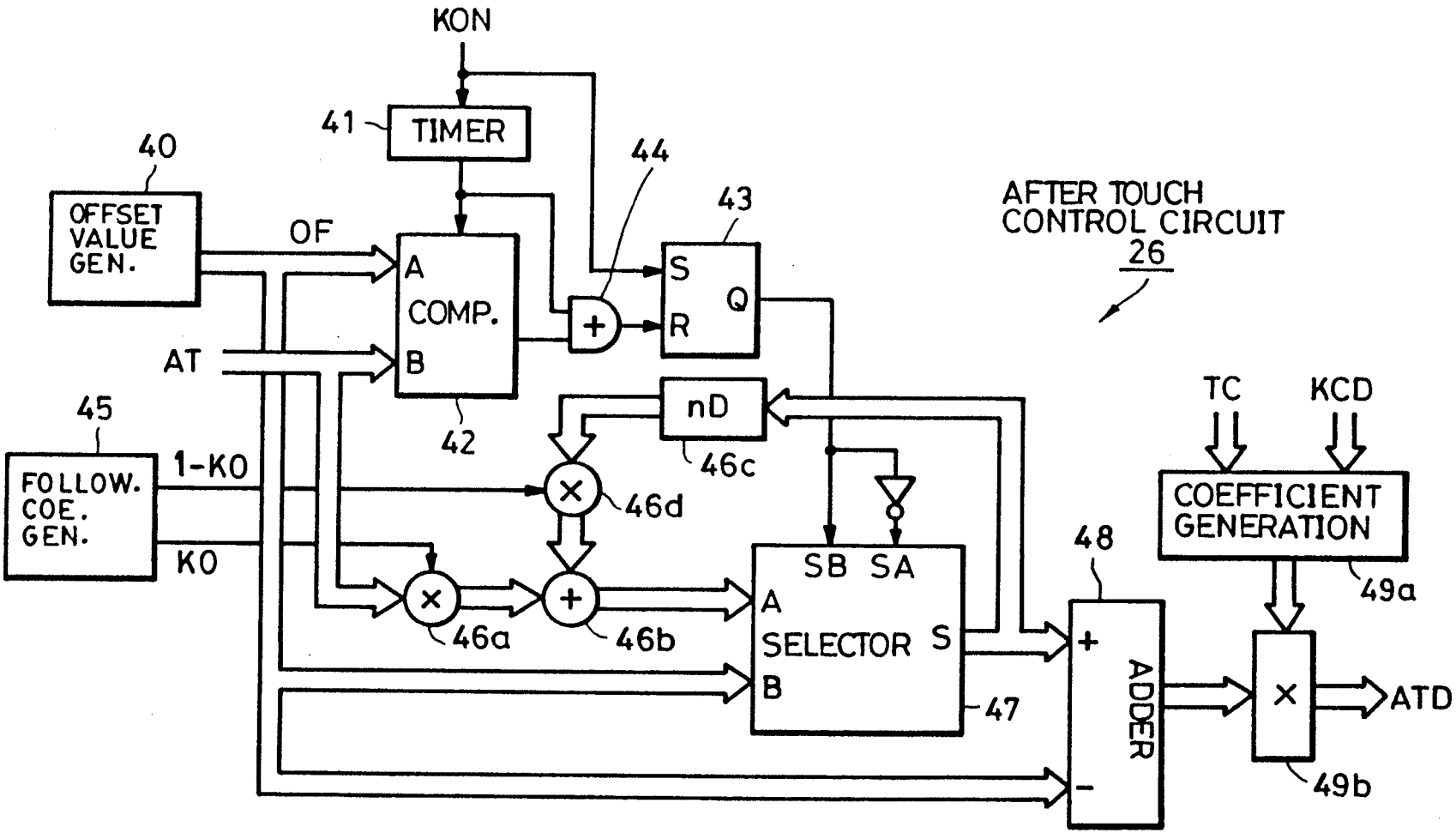
FIG. 10 is a block diagram showing a specific example of the after touch control circuit in FIG. 9.

A specific example of the after touch control circuit 26 is shown in FIG. 10. Prior to description of FIG. 10, the general concept of the operation of the after touch control circuit 26 will be described with reference to FIGS. 11*a* and 11*b*.

Figure 11A:
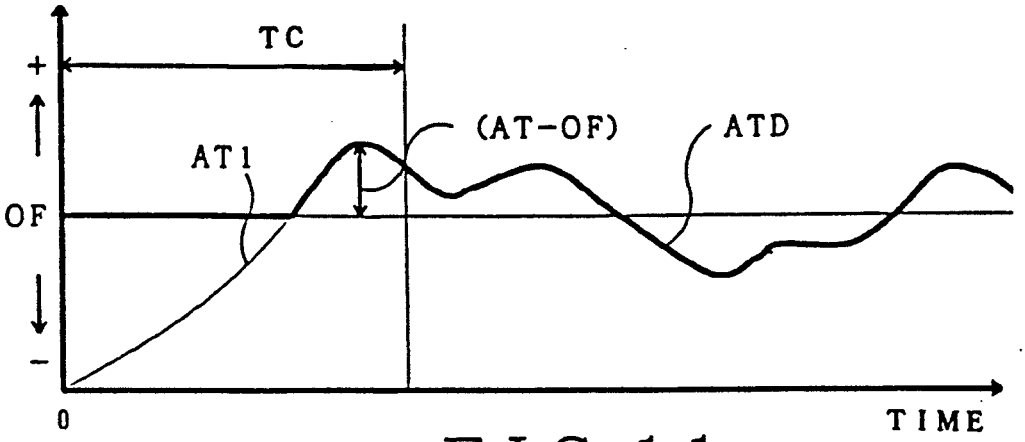
FIGS. 11*a* to 11*c* are diagrams showing an example of the relation between the output waveform of the after touch data and the offset value for describing the operation of the embodiment shown in FIGS. 9 and 10.
Figure 11B:
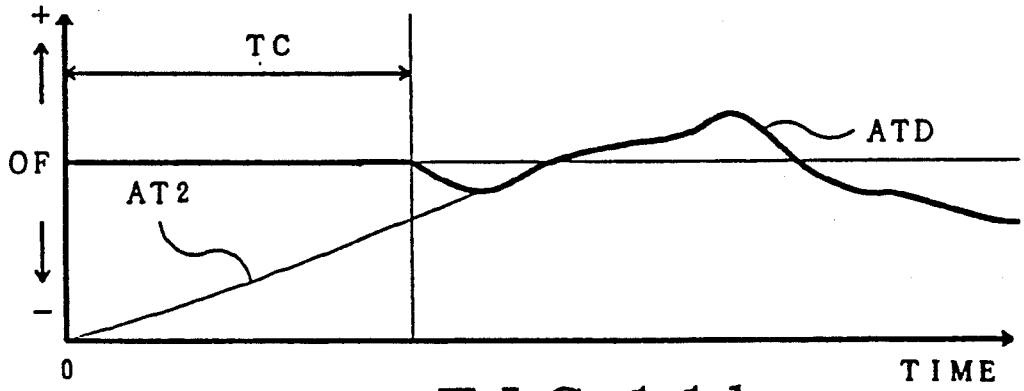

FIGS. 11*a* and 11*b* show the relationship between the output waveforms of after touch detection data during depression of a desired key and the offset value. In the figures, the time point at which depression of the key starts is 0.

FIG. 11*a* shows a case in which after touch detection data AT1 is larger than an offset value OF at a time point at which a predetermined time length Tc has elapsed after start of key-on, whereas FIG. 11*b* shows a case in which after touch detection data AT2 is smaller than the offset value OF.

In a case where, for example, the after touch detection data AT2 is smaller than the offset value OF during a time length from start of key-on till lapse of the predetermined time length Tc, a difference operation for obtaining the after touch data is not performed. That is, until the predetermined time length Tc has elapsed, the after touch control is not performed. This predetermined time length Tc generally is a brief period of time until the depressed key has reached the lowermost position and this signifies a standby time during a brief period of time until a real after touch detection output is obtained from the after touch detection circuit 23A.

In a case where, however, the after touch detection data AT1 becomes larger than the offset value OF before lapse of the predetermined time length Tc as shown in FIG. 11*a*, a difference value (AT−OF) between the after touch detection data AT1 and the offset value OF is operated from this time point and this difference value is supplied to the adder 28 and the tone signal generation circuit 25 as the after touch data ATD. This is because the case where the after touch data AT1 has exceeded the offset value OF before lapse of a predetermined period of time can be considered to be a case where real after touch detection data has already been obtained.

After lapse of the predetermined time length Tc after start of key-on, the difference value (AT−OF) between the after touch detection data AT1 and the offset value OF is computed and, after adjusting the touch sensitivity properly by touch sensitivity parameters, the difference value is supplied to the adder 28 and the tone signal generation circuit 25 as the after touch data ATD.

In a portion in which the after touch detection data AT is larger than the offset value OF, the difference value is provided as a positive value and in a portion in which the after touch data AT is smaller than the offset value OF, the difference value is provided as a negative value. In the adder 28 of FIG. 9, therefore, the difference value of a positive or negative value is added to the envelope shape from the envelope generation circuit 27. The tone signal generation circuit 25 which has received this envelope shape can increase or decrease tone volume, tone color, tone pitch etc. of the tone in either a positive or negative direction of the output value.

In this embodiment, in a case where the after touch data ATD2 is smaller than the offset value OF at a time point at which the predetermined time length Tc has elapsed as shown in FIG. 11*b*, the difference value (AT−OF) is not provided directly as the after touch data ATD but the after touch data ATD is caused to approach gradually to a real difference value (AT−OF).

In the after touch control circuit 26 of FIG. 10, an offset value generation circuit 40 generates a desired offset value OF. A desired offset value may be set by operation of an operator or determined in association with an operation such as a tone color selection operation. The generated offset value OF is supplied to a comparison circuit 42, a selector 47 and an adder 48.

A timer circuit 41 is provided for measuring the predetermined time length Tc. The timer circuit 41 measures the predetermined time length Tc from rising of the key-on signal KON provided by the key assigning circuit 32 and supplies a high level signal "1" to the comparison circuit 42 and an OR gate 44 at a time point at which the predetermined time length Tc has elapsed.

The comparison circuit 42 inputs the offset value OF from the offset value generation circuit 40 and the after touch detection data AT from the after touch detection circuit 23A of FIG. 9, compares the two signals in their magnitude and supplies a high level signal "1" to the OR gate 44 when the after touch detection data AT has exceeded the offset value OF.

A flip-flop 43 receives the key-on signal KON at its set terminal S and a logical sum output of the OR gate 44 at its reset terminal R. The flip-flop 43, therefore, continues to output a high level signal "1" to a selector 47 until the timer circuit 41 has counted the predetermined time length Tc from application of the key on signal KON or the after touch data AT has exceeded the offset value OF.

A multiplier 46*a* receives the after touch detection data AT, multiplies it with a predetermined following coefficient KO and supplies the result of multiplication to an adder 46*b*. The adder 46*b* adds outputs of multipliers 46a and 46d together and supplies the result of addition to a terminal A of the selector 47. A delay circuit 46c receives the output of the selector 47 and delays it by n channels and thereafter supplies the delayed signal to the multiplier 46d. The multiplier 46d multiplies the output of the delay circuit 46c with a predetermined following coefficient 1−K0 and supplies the result of multiplication to the adder 46b.

Thus, the output of the selector 47 is supplied to an adder 48 and also to the delay circuit 46c. The signal which has passed through the delay circuit 46c is delayed by one sampling period, multiplied with the following coefficient 1−K0 and thereafter is applied to the adder 46b. Simultaneously, data provided by multiplying the after touch detection data AT with the following coefficient K0 is supplied to the adder 46b and the two data are added together and the sum data is provided by the selector 47. This feedback loop consisting of the multipliers 46a and 46d, adder 46b and delay circuit 46c functions as a low-pass filter and thereby prevents abrupt change in the signal provided by the selector 47 when the A input has been selected. By this function as a low-pass filter, the after touch detection data provided by the selector 47 is caused to approach real after touch data ATD2 from the offset value as shown in FIG. 11b.

A following coefficient generation circuit 45 supplies predetermined following coefficents K0 and 1−K0 to the multipliers 46a and 46d for determining characteristic of this low pass filter. The condition of the following coefficient K0 is $1>K0>0$. The following coefficient K0 may be a fixed value or may be variable.

The adder 48 receives the output of the selector 47 at its positive input and the offset value OF at its negative input. That is, the adder 48 subtracts the offset value OF from the output of the selector 47 to provide a difference value between the two inputs. This difference value is supplied to a multiplier 49b. When, therefore, the input B is selected in the selector 47, the output of the adder 48 becomes zero so that the after touch control is not performed. On the other hand, when the input A is selected, the adder 48 produces a difference value (AT−OF) of a positive or negative value based on the offset value OF.

The multiplier 49b adjusts sensitivity of this difference value by multiplying the difference value provided by the adder 48 with a coefficient generated by a coefficient generation circuit 49a, i.e., touch sensitivity parameter and supplies the adjusted difference value to the adder 28 of FIG. 9 as final after rouch data ATD. This after touch data ATD is formed on a time shared basis for each channel and provided on a time shared basis.

The coefficient generation circuit 49a receives the key code KCD and the tone color selection signal TC and outputs a touch sensitivity parameter, i.e., coefficient, corresponding to these values. The coefficient generation circuit 49a stores a key scaling table of the coefficient for each of the tone colors and a key scaling table corresponding to a selected tone color is selected and a coefficient (i.e., sensitivity parameter) corresponding to the key code KCD in the selected table is read out and supplied to the multiplier 49b. Adjustment of touch sensitivity corresponding to the tone color and tone pitch can thereby be achieved.

The operation of this embodiment will now be described.

Upon depression of any key in the keyboard 30, the key-on signal KON is applied to the timer circuit 41. The timer circuit 41 thereby is reset and starts counting of elapsed time. Simultaneously, the key-on signal KON is applied to the set terminal S of the flip-flop 43, so that a high level signal "1" is provided from the output terminal Q of the flip-flop 43 and the selector 47 selects the input B. The adder 48 therefore receives the offset values of the same value at its positive and negative inputs, so that the difference value is zero and zero is produced as the after touch data ATD.

When the timer circuit 41 has finished counting of the predetermined time length Tc or the after touch detection data AT has exceeded the offset value OF before finishing of counting of Tc, a high level signal "1" applied to the reset input R of the flip-flop 43. The flip-flop 43 thereby produces a low level signal "0" from its output terminal Q and the selector 47 selects the input A.

At this time, if the after touch detection data AT is larger than the offset value OF as shown in FIG. 11a, the difference between input and output values is so small that the effect of the low-pass filter will be also small. If, however, there is a relatively large difference between the after touch detection data AT and the offset value OF at a time point at which the counting of the predetermined time length Tc has been completed as shown in FIG. 11b, the low-pass filter will act effectively, so that the output of the selector 47 is not switched immediately to the after touch detection data AT but will change smoothly from the offset value OF to the after touch detection data AT.

The adder 48 produces the output of the selector 47, i.e., the difference value between the after touch detection data AT and the offset value OF. The multiplier 49b produces the difference value which has been adjusted in touch sensitivity in accordance with the coefficient from the coefficient generation circuit 49a as the after touch data ATD.

As described above, the after touch control circuit 26 produces the after touch data ATD which is zero until lapse of the predetermined time length Tc after output of the key-on signal KON or until the after touch detection data AT has exceeded the offset value OF and, thereafter, produces, as the after touch data ATD, the difference value between the after touch detection data AT and the offset value OF which has been multiplied with a suitable touch sensitivity parameter coefficient. For preventing abrupt change in the after touch data ATD provided by the multiplier 49b due to an excessively large difference value between the after touch detection data AT and the offset value OF upon lapse of the predetermined time length Tc, the after touch data ATD is caused to pass through the low-pass filter to achieve a smooth change.

In the above described embodiment, common after touch data ATD is used for effecting the after touch control with respect to various tone elements such as tone volume and tone color. Alternatively, the after touch data ATD may be prepared independently for each of the tone elements such as tone volume and tone color which are the objects of the after touch control. In that case, after touch data ATD which is independent for each tone element may be prepared by differing the touch sensitivity parameter, i.e., coefficient, while using a common offset value. The offset value OF may also be made different for each of the tone elements which are the objects of the after touch control.

In the above described embodiment, the touch sensitivity parameter is stored in the table in the coefficient generation circuit 49*a*. The invention is not limited to this but the touch sensitivity parameter may be obtained by a suitable computation or may be set as desired by an operating person.

The control for changing the difference value by the touch sensitivity parameter is not limited by the multiplier 49*b* but may be effected by any other means.

Figure 11C:
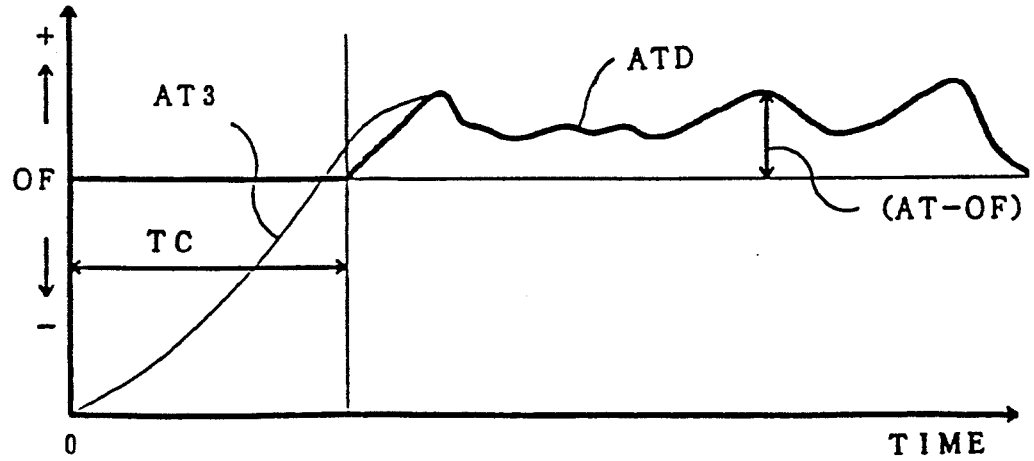

In the embodiment of FIG. 11*a*, the after touch control is performed when the after touch detection data AT has exceeded the offset value OF even before lapse of the predetermined time length Tc. Alternatively, the after touch control may be performed only after a time point at which the predetermined time length Tc has elapsed as shown in FIG. 11*c*. In the embodiment of FIG. 11*b*, the output after lapse of the predetermined time length Tc is caused to change gradually to connect smoothly to the after touch data. Alternatively, a linear interpolation as shown in FIG. 11*c* may be made or, alternatively further, the output may connect to the after touch detection data upon lapse of the predetermined time length Tc without performing the interpolation.

Further, the invention may be carried out in synchronism with the timing of the tone signal generation circuit 25 (e.g., sounding of a tone) without counting the predetermined time length Tc.

In the above described embodiment, the control in the positive direction is made when the after touch detection data is larger than the offset value and the control in the negative direction is made when the after touch detection data is smaller than the offset value. The control may however be made in the opposite manner.

It has been described that in the above described embodiment, the coefficients K0 and 1−K0 in the following interpolation may be either fixed or variable. It is however preferable that the coefficients K0 and 1−K0 are gradually changed during the following interpolation because it will enable a smooth following interpolation to be achieved. In this connection, another embodiment in which these coefficients K0, 1−K0 are changed will be described.

Figure 12:
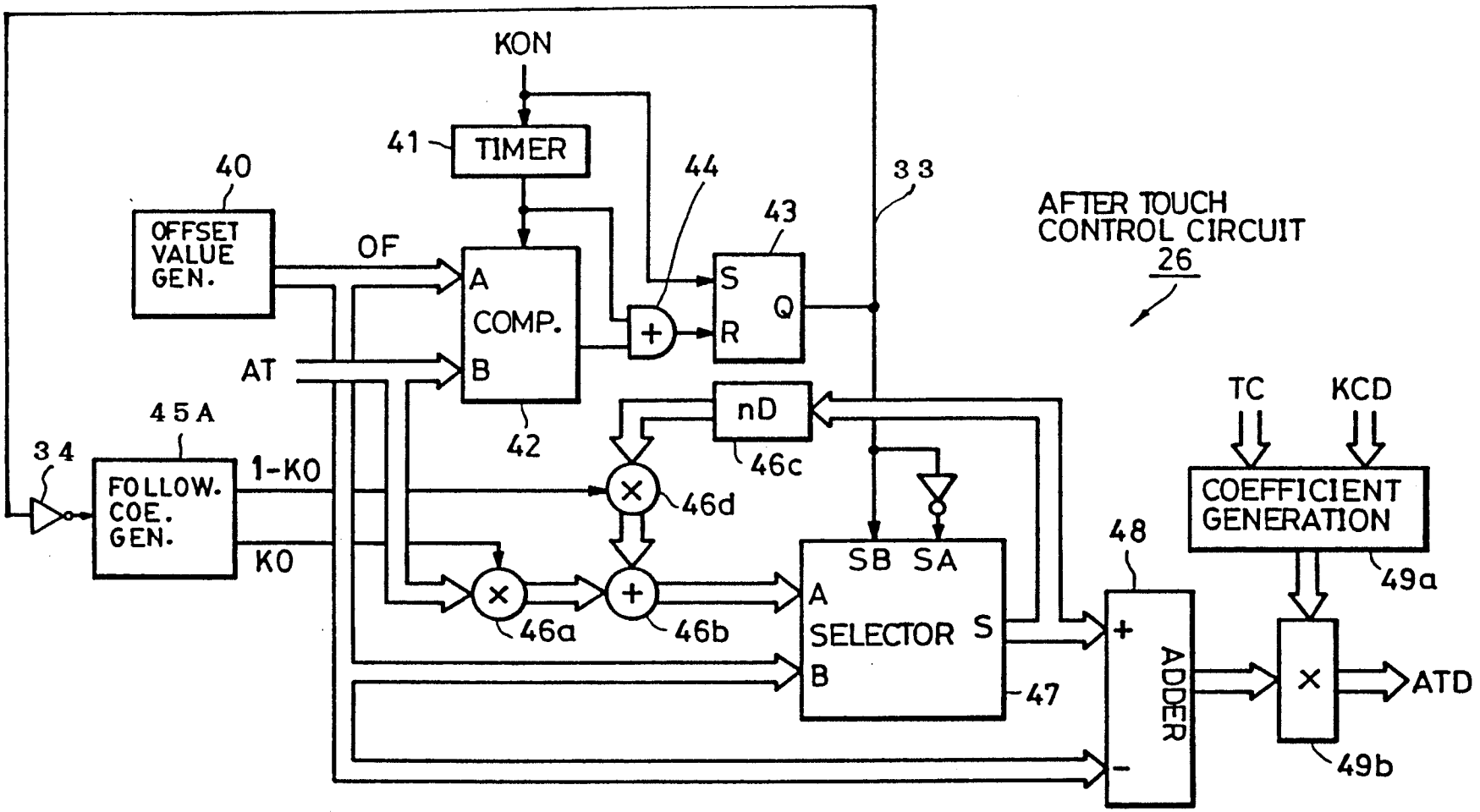
FIG. 12 is a block diagram showing a specific example of the after touch control circuit shown in FIG. 9.

In another embodiment of the electronic musical instrument according to the invention, the same construction as that of FIG. 9 may be employed as its entire construction. The portion of the after touch control circuit 26 in FIG. 9 is modified as shown in FIG. 12. In FIG. 12, the same reference characters as those in FIG. 10 denote the circuits performing the same functions. The circuit of FIG. 12 is different from that of FIG. 10 in that a following coefficient generation circuit 45A is different from the following coefficient generation circuit 45 of FIG. 10 and that the output of a flip-flop 43 is applied to the following coefficient generation circuit 45A through a line 33 and an inverter 34. In other respects, the circuit of FIG. 12 is the same as that of FIG. 10.

The basic concept of this embodiment will be first described. Components in parenthesis show corresponding parts in the embodiment.

The touch response device for an electronic musical instrument according to this embodiment comprises operation means for performing a tone (keyboard 30), control data generation means (after touch detection circuit 23A) for detecting an operation touch applied during operation of the operation means and generating data (after touch detection data AT) which changes in response to the detected operation touch as first control data, reference data generation means (offset value generation circuit 40) for generating reference data (offset value OF), transfer designation means (circuits 41, 42, 43 and 44) for designating transfer of data to be used for tone control from the reference data (offset value OF) to the first control data (after touch detection data AT), interpolation control means (circuits 46*a*, 46*b*, 46*c*, 46*d* and 47) for performing, when the transfer has been designated, following interpolation from the reference data (offset value OF) to the first control data (after touch detection data AT) and providing data obtained by the interpolation as second control data, coefficient change control means (following coefficient generation circuit 45A) for gradually changing the coefficient of the following interpolation and thereby enabling the second control data to change smoothly, and tone control means (the circuit portion as a whole from circuits 48, 49*a* and 49*b* to a tone signal generation circuit 25 through or not through an adder 28) for controlling a tone in response to the second control data.

The modified portion will now be described in detail.

In this embodiment, the following coefficient generation circuit 45A generates following coefficients KO and 1-KO which gradually change with lapse of time. As described previously, when a predetermined time length Tc has elapsed from start of key depression or when the after touch detection data AT has become larger than the offset value OF before lapse of the predetermined time length Tc, the flip-flop 43 is reset and a low-level signal "0" is produced from the output terminal Q thereof. This signal "0" is applied to an inverter 34 through a line 33 and thereby is inverted to a high level signal "1" and thereafter applied to the following coefficient generation circuit 45A. The following coefficient generation circuit 45A is triggered by turning of the signal from the inverter 34 from "0" to "1" to start generation of the coefficients KO and 1−KO. The coefficient KO in this case initially is a minimum value (e.g., 0) and gradually increases with lapse of time until it reaches a maximum value (e.g., 1). In the same manner as in the above described embodiment, KO is a decimal but it is not limited to $1>KO>0$ as in the above described embodiment but it may be $1 \geqq KO \geqq 0$. The coefficient 1−KO which is generated from the following coefficient generation circuit 45A simultaneously with KO gradually changes, conversely to KO, from a maximum value (e.g., 1) to a minimum value (e.g., 0). A specific circuit construction of such circuit generating numerical data which increases gradually with lapse of time may be designed by employing the time function generation circuit technique used, e.g., in known envelope generators, so that description about a specific example of the internal construction of the following coefficient generation circuit 45A will be omitted.

The operation of this embodiment will now be described. In the same manner as in the previously described embodiment, a key in the keyboard is depressed and the key-on signal KON is turned to a high level "1". In the meanwhile, the key operation touch applied during depression of the key is detected by the after touch detection circuit 23A and the after touch detection data AT is generated in response to the key depression touch. In response to start of key depression, the flip-flop 43 is set and data of offset value OF is selected in the selector 47 and applied to the adder 48. In this case, the data of the offset value OF is provided by the selector 47 as data for controlling the tone. In this embodiment, since a difference operation of OF−OF=0 is performed by the adder 48, the after touch data AT applied to the tone signal generation circuit 25 is 0 at the start of key depression.

Upon lapse of predetermined time length Tc from start of key depression or when the after touch detection data AT has exceeded the offset value OF before lapse of the predetermined time length Tc, the flip-flop 43 is reset and a trigger signal (a signal designating transfer from the offset value OF to the after touch detection data AT) is supplied to the following coefficient generation circuit 45A through the line 33 and inverter 34. In response thereto, the following coefficient generation circuit 45A starts generation of the following coefficient KO which gradually increases from the minimum value 0 to the maximum value 1 with lapse of time and the following coefficient 1−KO which gradually decreases from the maximum value 1 to the minimum value 0 with lapse of time. The selector 47 selects the output of the adder 46*b* applied to the A input.

Since initially the coefficients K0=0 and 1−K0=1, the after touch detection data AT is attenuated in the multiplier 46*a* whereas the output of the selector 47, i.e., data of the offset value OF, supplied through the delay circuit 46*c*, is positive fed back to the adder 46*b* at the full level through the multiplier 46*d*. Accordingly, the data of the offset value OF is initially provided by the adder 46*b*. K0 and 1−K0 represent the mixing ratio of the feedback data (i.e., preceding output of the selector) and the target value (after touch detection data AT). The smaller the value of K0, the larger is the ratio of the feedback data so that the followability to the target value becomes slow. In this embodiment, the coefficient K0 gradually increases and 1−K0 gradually decreases and, accordingly, the followability (rate of arrival) of the after touch data AT by the multiplier 46*a* gradually becomes high and, in inverse prorortion to it, the remaining rate of the offset value OF by the multiplier 46*d* gradually becomes low. As a result, the following interpolation from the offset value OF toward the after touch detection data AT is performed and, owing to the lapse of time in the followability described above, a smooth change from the offset value OF to the after touch detection data AT can be realized. In other words, the inclination of change is initially gradual in the process of change from the offset value OF to the after touch detection data AT, and then becomes increasingly steep and thence becomes gradual again as it approaches the after touch detection data AT which is the target value.

In the same manner as in the previously described embodiment, owing to the characteristic of the following interpolation control circuit section of the low-pass filter group type including the circuits 46*a*–46*d* and 47 using the coefficients K0 and 1−K0, the inclination of change of the interpolation output signal (i.e., output of the selector 47) becomes gradual as the interpolation output signal approaches the target value (after touch detection data AT). In the embodiment of FIG. 12, the inclination of change, i.e., rising, from the interpolation start value (offset value OF) can be made gradual by gradually changing the coefficients K0 and 1−K0 in addition to the characteristic of the following interpolation control circuit section.

In a case where the final value, i.e., the maximum value, of the change of the coefficient K0 has been set to 1, subsequent output of the selector 47 coincides with the after touch detection data AT. In a case where the final value, i.e., the maximum value, of the change of the coefficient K0 has been set at a suitable value below 1, the interpolation is continued thereafter so as to constantly follow the target value (after touch detection data AT) and the output of the selector 47 follows smoothly the after touch detection data AT, though there is no complete coincidence between them. These two cases both fall within the scope of the invention.

In the example corresponding to FIGS. 11*a* to 11*c*, an example of the following interpolation realized by the embodiment of FIG. 12 is shown in FIGS. 13*a* to 13*c*. In these figures, the waveform of a transfer portion from the offset value OF to the after touch detection data AT is shown in an enlarged scale. The waveform designated by reference characters ATD is the following interpolation output obtained by the embodiment of FIG. 12.

Figure 14:
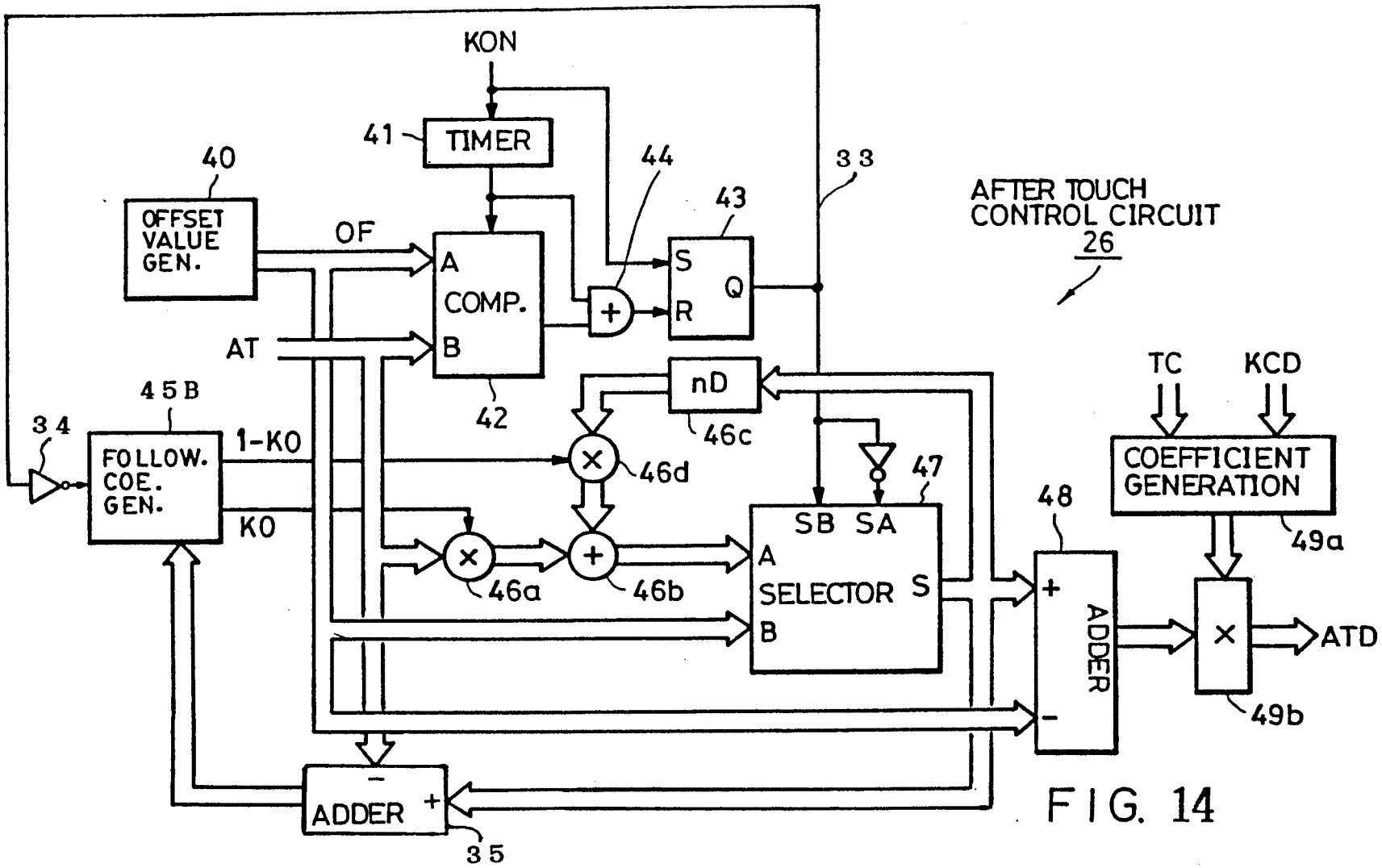
FIG. 14 is a block diagram showing a modified example of the after touch control circuit of FIG. 12.

A modified embodiment which achieves the same object as the embodiment of FIG. 12 but adopts a different manner of changing the coefficient K0 is shown in FIG. 14. FIG. 14 shows, as FIG. 12 does, a modified example of the after touch control circuit 26. The same reference characters through FIGS. 12 and 14 designate the circuits of the same functions. The circuit of FIG. 14 is different in that the following coefficient generation circuit 45B of FIG. 14 does not generate the coefficients K0 and 1−K0 in the form of a time function as in the following coefficient generation circuit 45A of FIG. 12 but generates coefficients KO and 1−Ko which change in response to the output of the adder 35.

In FIG. 14, the adder 35 obtains the difference between the output of the selector 47 (i.e., output data of the following interpolation control circuit section of the low-pass filter group type including the circuits 46*a*–46*d* and 47, i.e., current value of the second control data obtained as a result of the following interpolation) and the after touch detection data AT (i.e., the target value of the following intrepolation, i.e., the value of the first control data).

The following coefficient generation circuit 45B receives the output signal of the adder 35 and generates the following interpolation coefficients K0 and 1−K0 which change in accordance with the difference between the current value of the following interpolation and the target value. In the same manner as in the previously described embodiment, the signal of the output terminal Q of the flip-flop 43 is applied to the following coefficient generation circuit 45B through the line 33 and the inverter 34 and the circuit 45B is triggered by turning of this signal from "0" to "1" to start generation of the coefficients K0 and 1−K0. In the same manner as in the previously described embodiment, the coefficient K0 is initially the minimum value and the coefficient 1−K0 is the maximum value. In accordance with the difference between the current value of the following interpolation and the target value (the difference may be an absolute value) provided by the adder 35, the value of K0 is gradually increased and the value of 1−K0 is gradually decreased as this difference is decreased. The current value of the following interpolation is initially the offset value OF and the difference from the target value is at the maximum. As the following interpolation proceeds, this difference is decreased. The following coefficient generation circuit 45B may be specifically constructed suitably, e.g., of a table from which K0 and 1−K0 are read in response to the difference data provided by the adder 35 and description of an example of specific circuit construction will be omitted. Since the embodiment of FIG. 14 is operated in the same manner as the embodiment of FIG. 12, description of the operation of the embodiment of FIG. 14 will be omitted.

In the embodiments of FIGS. 12 to 14, data used ultimately as a tone control signal in controlling a tone on the basis of control data obtained from the selector 47 is, in the same manner as in the embodiments of FIGS. 9 to 3, difference data between the output data of the selector 47 and the offset value OF provided by the adder 48. The inventive concept underlying the embodiments of FIGS. 12 to 14 however may be applied also to other tone control methods.

For example, in the embodiments of FIGS. 12 to 14, the adder 48 may be omitted and the output of the selector 47 may be supplied to the tone signal generation circuit 25 directly or through a proper sensitivity adjusting circuit or other circuit.

As the reference data in the embodiments of FIGS. 12 to 14, not only the offset value OF but the initial touch detection data IT generated by the initial touch detection circuit 231 may be used. In that case, the tone control may be made in response to the difference data between the output data of the selector 47 and the reference data, i.e., initial touch detection data IT without omitting the adder 48. Alternatively, the output of the selector 47 may be supplied to the tone signal generation circuit 25 directly or through a suitable sensitivity adjusting circuit without providing the adder 48.

The functions of the following coefficient generation circuits 45A and 45B of FIGS. 10 and 14 may be combined together so that the following coefficients K0 and 1−K0 gradually change in accordance with both lapse of time and difference between the current value and the target value.

In FIGS. 10, 12 and 14, the following interpolation control circuit section of the low-pass filter type consisting of the circuits 46*a*–46*d* and 47 is of a construction for a primary interpolation (primary filter). This circuit section is not limited to this but a construction for a secondary interpolation (secondary filter) as shown in FIG. 15 may be employed. In FIG. 15, delay circuits 46*c*1 and 46*c*2 respectively delay a signal by one sample time (n channel time division time). The outputs of the delay circuits 46*c*1 and 46*c*2 are multiplied with coefficients K1 and K2 by multipliers 46*d*1 and 46*d*2 and the results of multiplication are added together by an adder 46*b*2. A multiplier 46*a* multiplies the after touch detection data AT with the following coefficient K0 in the above described manner and the result of multiplication and the output of the adder 462*b* are added together by an adder 46*b*1. The sum signal from the adder 46*b*1 is applied to the selector 47. In this case, the following interpolation can be made by establishing the relation K1=1−K0−K2. Multiple degree interpolation (multiple degree filter) exceeding secondary interpolation is also possible.

In the above embodiments, the system is constructed of a hardware circuit designed exclusively for the purpose of the invention. The same function may also be realized by a computer software processing.

Only one of the tone elements such as tone volume, tone color and tone pitch may be selected as the object of the after touch control.

In the above described embodiments, description has been made on the assumption that the channel number n is 16. The channel number is not limited to this but other channel numbers may be used even for a monophonic instrument. The processing is not limited to a time division processing but a parallel procesing may also be employed.

The sensor for detecting after touch may be provided independently for each key or provided commonly for plural keys.

In the above described embodiments, description has been made about an electronic musical instrument in which a desired tone is designated by a keyboard. The performance operation means for designating the tone pitch is not limited to the keyboard but other performance operation means may be employed. The invention is also applicable to a tone source module unit having no keyboard. In the present invention, "keys" are not limited to keys in a keyboard but may be keys of other tone designation operation means. The operation means for designating the tone pitch may include separate performance operation means for touch response and after touch applied to this performance operation means may be detected.

The offset value may be variable with lapse of time instead of being a constant value. Similarly, the touch sensitivity parameter coefficient may be variable with time.

As described in the foregoing, according to the invention, since difference data between touch data and desired offset value is utilized for tone control, the touch data can be changed in any of positive and negative directions and, as a result, a touch control in which tone elements such as tone pitch, tone volume, tone color and tonal effects can be increased or decreased in any of positive and negative directions can be realized. Further, since touch sensitivity can be adjusted by changing the difference data by suitable touch sensitivity parameter such as tone color or key scaling, a touch response control which is rich in expression can be performed.

Further, according to the invention, since the coefficients for following interpolation are caused to gradually change when data which changes gradually from reference data to first control data by following interpolation is generated as second control data, the second control data obtained by the following interpolation changes smoothly and, accordingly, abrupt change in a tone control signal can be prevented and a touch response control which is not accompanied by unnaturalness can be realized.

What is claimed is:

1. A touch response device for an electronic musical instrument comprising:

performance operation means for making performance operation for a tone;

touch data generation means for detecting an operation touch applied during operation of the performance operation means and generating touch data in response to the detected operation touch;

reference value generation means for generating a desired reference value;

control data generation means for obtaining a difference between the reference value and the touch data and generating control data having either of positive and negative values depending upon the difference to thereby provide a tone control in either of positive and negative directions; and tone control means for controlling a tone in response to the control data.

2. A touch response device as defined in claim 1 wherein said reference value generation means generates the reference value corresponding to a tone color of a tone to be generated.

3. A touch response device as defined in claim 1 wherein said reference value generation means generates the reference value corresponding to a tone pitch of a tone to be generated.

4. A touch response device as defined in claim 2 wherein said reference value generation means changes the reference value corresponding to the tone color in accordance with a tone pitch of the tone to be generated.

5. A touch response device as defined in claim 1 which further comprises following interpolation control means for performing a following interpolation from the reference value toward the current value of the touch data and thereby generating second touch data which starts from the reference value and changes continuously toward the current value of the touch data, and said control data generation means obtains a difference between the reference value and the second touch data when said following interpolation means is performing the following interpolation and generates the control data on the basis of this difference.

6. A touch response device as defined in claim 1 wherein said control data generation means comprises operation means for obtaining the difference between the reference value and the touch data and sensitivity adjusting means for adjusting the difference obtained by said operation means by desired touch sensitivity parameter and providing the adjusted difference as said control data.

7. A touch response device for an electronic musical instrument comprising:

performance operation means for making performance operation for a tone;

control data generation means for detecting an operation touch applied during operation of the performance operation means and providing, as first control data, data which changes in response to the detected operation touch;

reference data generation means for generating reference data;

transfer instruction means for instructing for a transfer of data used for tone control from the reference data to the first control data;

interpolation control means for performing, when said transfer has been instructed, a following interpolation from the reference data to the first control data and providing data obtained by the interpolation as second control data;

coefficient change control means for changing a coefficient of the following interpolation progressively with time and thereby enabling the second control data to change smoothly; and tone control means for controlling a tone in response to the second control data.

8. A touch response device for an electronic musical instrument as defined in claim 7 wherein said coefficient change control means gradually changes the coefficient of the following interpolation in accordance with lapse of time.

9. A touch response device as defined in claim 7 wherein said coefficient change control means changes the coefficient of the following interpolation in accordance with a difference between the value of the first control data and the current value of the second control data.

10. A touch response device as defined in claim 7 wherein said reference data generation means generates data representing a desired offset value as the reference value; and said tone control means controls a tone in accordance with a difference between the second control data and the offset value during the following interpolation and thereafter controls the tone in accordance with a difference between the first control data and the offset value.

11. A touch response device as defined in claim 7 wherein said reference data generation means detects an initial operation touch applied to said performance operation means and provides data corresponding to this initial operation touch as the reference data.

12. A touch response device as defined in claim 7 wherein said transfer instruction means instructs for the transfer upon lapse of a predetermined period of time after operation of said performance operation means.

13. A touch response device as defined in claim 12 wherein said transfer instruction means designates, when the value of the first control data has crossed the value of the reference data before lapse of the predetermined period of time, said transfer at a time point when this crossing has been made.

14. A touch response device as defined in claim 1 wherein said reference value generation means generates plural reference values respectively corresponding to elements of a tone to be generated, said control data generation means generates plural control data based on the plural reference values, and said tone control means respectively controls the elements of the tone in response to the plural control data.

15. A touch response device as defined in claim 14 wherein said control data generation means comprises operation means for obtaining differences between each of the reference values and touch data, and sensitivity adjusting means for respectively adjusting the difference data obtained by said operation means by desired touch sensitivity parameters respectively corresponding to the elements of the tone and providing the adjusted difference data as said control data.

* * * * *